US007409735B2

(12) United States Patent
Kramer et al.

(10) Patent No.: US 7,409,735 B2
(45) Date of Patent: Aug. 12, 2008

(54) DYNAMIC CELLULAR PERSON SUPPORT SURFACE

(75) Inventors: Kenneth L. Kramer, Greensburg, IN (US); Marshall S. Dahneke, Batesville, IN (US); John P. Biondo, Greensburg, IN (US); Reed N. Wilcox, Ridgefield, CT (US); David T. Schwanemann, Cincinnati, OH (US); Douglas E. Borgman, Batesville, IN (US); John D. Miller, Brookville, IN (US); David J. Ulrich, Sunman, IN (US); Daniel J. Ulrich, Hamilton, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 11/204,632

(22) Filed: Aug. 16, 2005

(65) Prior Publication Data

US 2006/0085919 A1 Apr. 27, 2006

Related U.S. Application Data

(60) Provisional application No. 60/601,924, filed on Aug. 16, 2004.

(51) Int. Cl.
*A47C 27/08* (2006.01)
*A47C 27/10* (2006.01)
*A47C 27/14* (2006.01)

(52) U.S. Cl. ..... 5/713; 5/710; 5/709; 5/714

(58) Field of Classification Search ..... 5/713, 5/709, 654, 710, 715, 714

See application file for complete search history.

(56) References Cited

U.S. PATENT DOCUMENTS

| | | | | |
|---|---|---|---|---|
| 3,605,145 | A | 9/1971 | Graebe | |
| 3,870,450 | A | 3/1975 | Graebe | |
| 4,005,236 | A | 1/1977 | Graebe | |
| 4,022,195 | A | 5/1977 | Meyer et al. | |
| 4,541,136 | A | 9/1985 | Graebe | |
| 4,542,547 | A | 9/1985 | Sato | |
| 4,592,345 | A | 6/1986 | Wahl | |
| 4,698,864 | A | 10/1987 | Graebe | |
| 4,729,598 | A | 3/1988 | Hess | |
| 4,852,195 | A * | 8/1989 | Schulman | 5/713 |
| 4,982,466 | A | 1/1991 | Higgins et al. | |
| 4,989,283 | A | 2/1991 | Krouskop | |
| 5,003,654 | A | 4/1991 | Vrzalik | |
| 5,020,176 | A * | 6/1991 | Dotson | 5/710 |
| 5,023,967 | A | 6/1991 | Ferrand | |
| 5,051,673 | A | 9/1991 | Goodwin | |
| 5,052,068 | A | 10/1991 | Graebe | |

(Continued)

OTHER PUBLICATIONS

Otto Bock Seating and Positioning Products, Otto Bock Health Care, Jun. 2002, 12 pages, printed in USA.

(Continued)

*Primary Examiner*—Patricia Engle
*Assistant Examiner*—Jonathan J Liu
(74) *Attorney, Agent, or Firm*—Barnes & Thornburg LLP

(57) ABSTRACT

A person support surface comprises a multitude of inflatable cells. The cells are inflated and deflated to adjust an interface pressure between the person support surface and a person supported by the surface.

26 Claims, 9 Drawing Sheets

U.S. PATENT DOCUMENTS 5,060,326 A 10/1991 Oswald
5,062,169 A 11/1991 Kennedy et al.
5,111,544 A 5/1992 Graebe
5,117,518 A 6/1992 Schild
5,129,115 A 7/1992 Higgins et al.
5,138,729 A 8/1992 Ferrand
5,152,023 A 10/1992 Graebe
5,163,196 A 11/1992 Graebe et al.
5,192,304 A 3/1993 Rassman
5,193,237 A 3/1993 Holdredge
5,237,501 A * 8/1993 Gusakov ..... 600/587
5,269,030 A 12/1993 Pahno et al.
5,279,010 A 1/1994 Ferrand et al.
5,323,500 A 6/1994 Roe et al.
5,345,629 A 9/1994 Ferrand
5,379,471 A 1/1995 Holdredge
5,438,721 A 8/1995 Pahno et al.
5,446,933 A 9/1995 Gabelhouse
5,462,516 A 10/1995 Anderson
5,487,197 A 1/1996 Iskra, Jr. et al.
5,500,965 A 3/1996 Hannagan et al.
5,509,155 A 4/1996 Zigarac et al.
5,533,217 A 7/1996 Holdredge
5,542,136 A 8/1996 Tappel
5,588,167 A 12/1996 Pahno et al.
5,637,076 A 6/1997 Hazard et al.
5,678,891 A 10/1997 O'Neill et al.
5,687,438 A 11/1997 Biggie et al.
5,762,618 A 6/1998 Yamanaka et al.
5,792,082 A 8/1998 Yamanaka et al.
5,802,640 A 9/1998 Ferrand et al.
5,813,727 A 9/1998 Sugawa et al.
5,815,864 A * 10/1998 Sloop ..... 5/706
5,860,699 A 1/1999 Weeks
5,873,137 A 2/1999 Yavets-Chen
5,893,184 A 4/1999 Murphy
5,926,884 A 7/1999 Biggie et al.
6,056,707 A 5/2000 Hayashi
6,065,806 A 5/2000 Miyaguchi et al.
6,073,284 A 6/2000 Borders
6,212,719 B1 4/2001 Thomas et al.
6,269,504 B1 8/2001 Romano et al.
6,315,744 B1 11/2001 Inaba
6,487,738 B1 12/2002 Graebe
6,487,739 B1 12/2002 Harker
6,502,263 B1 1/2003 Rowley et al.
6,560,803 B2 5/2003 Zur
6,687,937 B2 2/2004 Harker
6,701,556 B2 3/2004 Romano et al.
6,721,981 B1 4/2004 Greenhalgh et al.
6,782,573 B2 8/2004 Odderson
6,823,549 B1 11/2004 Hampton et al.
6,829,797 B2 12/2004 Partian
7,069,610 B1 7/2006 Chai
2002/0073489 A1 6/2002 Totton et al.
2002/0183667 A1 12/2002 Kitadou et al.
2003/0025366 A1 2/2003 Barreiro, Jr.
2003/0139693 A1 7/2003 Swift
2004/0045090 A1 * 3/2004 Tsai ..... 5/709
2006/0010607 A1 1/2006 Schneider
2006/0112489 A1 * 6/2006 Bobey et al. ..... 5/655.3

OTHER PUBLICATIONS

Duogel Cushion, Cape, date unknown, two pages.
Ad for The Airpulse PK, Aquila Corporation, New Mobility, published by No Limits Communications, Inc., Jan. 2005, p. 43.
CushionAir by Comfortechnology, date unknown, one page.
Starlock, Star Cushion Products, Inc., date unknown, one page.
Star Short Contour Cushion, date unknown, one page.
Dan Medica South Ltd., DebbonAirMaitress Sections, date unknown, one page.
ProContour ComforT Cushion, Otto Bock Health Care, date unknown, one page.
The Roho Harmony Cushion, The Roho Group, date unknown, one page.
Support Surface Products, Dry Floatation Mattress Overlay, a Roho Group Product, date unknown, p. 19.
PCT International Search Report dated Sep. 25, 2007, for PCT/US05/29075 (7175-78468) (4 pages).

* cited by examiner

DYNAMIC CELLULAR PERSON SUPPORT SURFACE

This application claims the benefit, under 35 U.S.C. § 119(e), of U.S. Provisional Patent Application Ser. No. 60/601,924 which was filed Aug. 16, 2004 and which is hereby incorporated by reference herein in its entirety.

BACKGROUND OF THE INVENTION

The present disclosure relates to support surfaces, and particularly, to support surfaces for chairs, beds, wheelchairs, couches, stretchers, or other pieces of person-support furniture. Some aspects of the present disclosure relate to support devices having support surfaces with associated apparatus for adjusting the interface pressure between the support surface and a person supported by the support surface.

Incapacitated or otherwise immobile people spend a great deal of time sitting or lying on various types of support devices such as chairs, beds, couches, and wheelchairs. For example, patients in hospitals or other healthcare facilities are typically supported on hospital beds, stretchers, wheelchairs and other means of support and conveyance. It is desirable to control interface pressures between these support devices and the patients supported thereon in order to prevent complications of prolonged immobility, such as pressure sores. Some prior art support systems alternately inflate and deflate various air bladders of a patient support surface to, for example, rotate the patient cyclically from side-to-side or to change which air bags among two or more sets of alternating, laterally extending air bags are primarily responsible for supporting the patient.

SUMMARY OF THE INVENTION

The present invention comprises an apparatus having one or more of the features recited in the claims or one or more of the following features, which alone or in any combination may comprise patentable subject matter:

A person support surface may have a plurality of inflatable cells. The person support surface may also have a plurality of pressure sensors. Each pressure sensor may be associated with a corresponding one of the plurality of inflatable cells and may sense a pressure at which the corresponding inflatable cell is inflated. The person support surface may further have a plurality of drivers. Each driver may be associated with a corresponding one of the plurality of inflatable cells. Each driver may be operable to individually inflate the corresponding inflatable cell.

The plurality of inflatable cells each may have an interior region in which the associated pressure sensor is situated. Additionally or alternatively, each of the plurality of drivers may be situated in the interior region of the corresponding inflatable cell. The plurality of drivers may be configured so that pressurized air in the plurality of cells is ventable out of the plurality of cells through the associated driver. The plurality of inflatable cells may comprise a plurality of upstanding cylindrical cells. The person support surface may have a second plurality of inflatable cells which are inflated and deflated as a group.

The person support surface may further comprise a controller coupled to each of the plurality of pressure sensors to receive pressure data therefrom. The controller may be coupled to each of the plurality of drivers and operable to signal the plurality of drivers to further inflate the corresponding inflatable cell. A plurality of temperature sensors may be provided to sense the temperature of a portion of each of the plurality of inflatable cells. A plurality of foam pads may be provided with each foam pad being situated adjacent a top of a corresponding one of the plurality of inflatable cells. The temperature sensors may be embedded within a corresponding one of the plurality of foam pads. The controller may be operable to command the operation of the drivers to inflate and deflate the inflatable cells to raise and lower, respectively, the foam pads so as to alter an interface pressure between the foam pads and a person supported thereabove.

Each inflatable cell of the plurality of inflatable cells may comprise an upper inflatable chamber and a lower inflatable chamber. Each of the plurality of drivers may be operable to separately inflate the upper and lower inflatable chambers of the corresponding inflatable cell. Each of the drivers may be situated within the lower inflatable chamber of the corresponding inflatable cell. The lower inflatable chamber of each of the inflatable cells may be configured as a bellows that is expandable and retractable to raise and lower, respectively, the corresponding upper inflatable chamber. The controller may be operable to command the operation of the drivers to inflate and deflate the lower inflatable chambers to raise and lower, respectively, the upper inflatable chambers so as to alter an interface pressure between the upper inflatable chambers and a person supported thereabove.

At least some of the inflatable cells may comprise a top surface having at least one opening through which pressurized air is expelled upwardly. At least some of the inflatable cells may comprise a bottom surface having at least one opening through which pressurized air is expelled downwardly. The person support apparatus may further comprise a topper covering the plurality of inflatable cells. The topper may comprise foam. Additionally or alternatively, the topper may comprise an undulated mesh material. A cover, such as upholstery, may cover the plurality of inflatable cells and, if included, the topper. The cover may completely encase the plurality of inflatable cells and, if included, the topper. The cover may only partially cover any of the top, sides, ends, and bottom of these elements.

The plurality of inflatable cells may be arranged in an array of rows and columns. The controller may command the plurality of drivers to inflate and deflate each of the plurality of inflatable cells in a preprogrammed manner. The controller may command the plurality of drivers to inflate and deflate each of the plurality of inflatable cells to raise and lower, respectively, the upper surfaces of the inflatable cells in a preprogrammed manner. The controller may be operable to determine which of the plurality of inflatable cells is supporting a person based on data received from the pressure sensors. The controller may be operable to command the operation of the drivers so as to substantially equalize the pressures in those inflatable cells of the plurality of inflatable cells which have been determined to be supporting the person.

In accordance with this disclosure, a person support surface may comprise a plurality of inflatable cells arranged in an array of rows and columns. A first group of the rows may have a first subset of the inflatable cells and a second subset of the inflatable cells. A second group of the rows may have a third subset of the inflatable cells and a fourth subset of the inflatable cells. The rows of the first group of rows may alternate with the rows of the second group of rows.

An inflation control system may be operable to selectively inflate and deflate the plurality of inflatable cells. The inflation control system may have an alternating pressure mode in which each of the inflatable cells of the first, second, third, and fourth subsets of inflatable cells are sequentially deflated and then re-inflated substantially as a group such that during the alternating pressure mode various ones of the first, second, third, and fourth subsets of inflatable cells are deflated while the other three of the first, second, third, and fourth subsets of inflatable cells are inflated. The inflated cells may have a first set point pressure that is above atmospheric pressure. The deflated cells may have a second set point pressure that is less than the first set point pressure but above atmospheric pressure. The deflated cells may have a set point pressure that is substantially equal to atmospheric pressure.

The person support surface may further comprise an inflatable lumbar bladder. One portion of the lumbar bladder may be supported by one of the rows of the first group or rows and another portion of the lumbar bladder may be supported by one of the rows of the second group or rows. The person support surface may have a topper, such as a foam topper or topper made from an undulated mesh material, and the lumbar bladder may be situated between some of the plurality of inflatable cells and the topper.

The plurality of inflatable cells may be formed by first and second sheets of material which are coupled together along a plurality of longitudinal seams and a plurality of lateral seams. The longitudinal seams and the lateral seams may comprise straight seams. The longitudinal seams and the lateral seams may comprise welded seams.

Some of the first and second groups of rows may be associated with a back section of the person support apparatus and others of the first and second groups of rows may be associated with a seat section of the person support apparatus. The inflation control system may comprise a first source of pressure to inflate the inflatable cells of the back section and a second source of pressure to inflate the inflatable cells of the seat section. The back section may further comprise an inflatable lumbar bladder which is inflated by the second source of pressure, which is the source of pressure that otherwise inflates the inflatable cells of the seat section. The person support surface may further comprise a user input device which is operable by a user to increase and decrease set point pressures of the inflatable cells of the back section and the seat section and to control a time period between which the first, second, third, and fourth subsets of inflatable cells are deflated. The user input device may comprise a hand-held pendant. The user input device may further be operable by a user to increase or decrease the set point pressure of the lumbar bladder.

Each of the inflatable cells may be independently inflated and deflated. The person support surface, therefore, may be considered to be a dynamic cellular person support surface. Pressure and temperature may be sensed at a multitude of places across the support surface. The pressure and temperature information may be used by the controller to determine the manner in which to inflate and deflate the plurality of inflatable cells so as to enhance conformance of the surface to the body contours of a person supported on the surface. The person support surface may be configured to provide air circulation to eliminate hot or cold spots. The controller for the driver of each inflatable cell may be programmed to raise and lower the upper surface of the inflatable cell to massage the person resting thereon.

In some embodiments, each inflatable cell may comprise an upper portion and a lower portion. The upper portion may be movable upwardly and downwardly relative to the lower portion. A driver may be provided to raise and lower the upper portion, or to urge it upwardly or relax it downwardly, and a controller may command the operation of the driver. The controller may comprise one or more sensors that sense the presence of a portion of the person on the inflatable cells and control circuitry that operates the drivers in response to signals received from the one or more sensors. Each inflatable cell and its associated driver and controller may be considered to be a vertically self adjusting cell programmed to provide a desired interface pressure between the cell and the portion of the person resting on or above the cell. It will be appreciated that there may be covers and other layers of material over a plurality of such cells.

A plurality of inflatable cells may be assembled together providing a mattress having an upper body section, a seat section and a leg section. Some or all of the seat section may be movable away from the upper body section and leg section to provide a seat support section movable with the person from the bed to a wheelchair, stretcher, car seat or the like. Air may be expelled downwardly from some of the inflatable cells to provide an air bearing for facilitating movement of the mattress or associated mattress section from one supporting device to another. The air bearing may be provided on the structure which supports the seat section, for example.

In some embodiments, the complete mattress with its head section, seat section, and leg section may be supported on a frame that will itself convert from a bed to a chair or from a chair to a bed. In one embodiment, a complete mattress will be carried by a chair which is relatively mobile and which may be, at times, reclined to serve more as a recliner or as a bed. In some embodiments, the bed may have powered casters.

Each inflatable cell may comprise its own temperature sensor to determine the surface temperature thereabove. An air temperature regulation system may be operable to provide heated or cooled air within, or through, each of the inflatable air cells. A controller coupled to the temperature sensors may control heating and cooling elements included in such an air flow system and associated with the plurality of inflatable cells.

Additional features, which alone or in combination with any other feature(s), such as those listed above, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION OF THE DRAWINGS

Figure 1:
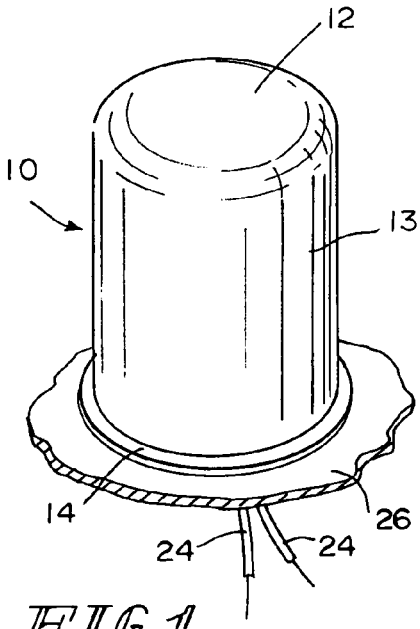
FIG. 1 is a perspective view of an inflatable cell supported on an underlying substrate.

FIG. 1 shows an inflatable cell 10, which in conjunction with a plurality of other such cells 10, comprises a surface for supporting a person. In this disclosure, including in the claims, the term "surface" is oftentimes intended to mean an apparatus that supports a person and is not intended to be limited to a plane or curved two-dimensional locus of points. For example, a mattress is considered to be a "surface" in accordance with this disclosure. Surfaces may, therefore, be stand-alone surfaces that may be placed on a bed frame and surfaces may be integrated with a bed frame. In the case of inflatable person support surfaces, the apparatus for controlling the inflation and deflation of the inflatable portions of the surface are considered to be part of the person support surface. In some embodiments, means for heating or cooling inflatable cells 10 is provided and is also considered to be part of the person support surface. Some person support surface embodiments include pressure sensors. Some person support surface embodiments include temperature sensors. Some embodiments include a system joining area to facilitate joining a plurality of cells 10 into a system. Some embodiments include a vertical height adjustment mechanism associated with each of the inflatable cells of the person support surface.

Illustrative cell 10 is vertically extending and has an upper surface portion 12, a lower base portion 14, and a cylindrical side wall 13 extending between portions 12, 14. Portion 12 and wall 13 blend smoothly at a rounded annular corner region. However, cell 10 is considered to be a cylindrical cell 10. Under normal load conditions, the upper surface portion 12 is movable upwardly and downwardly relative to the lower base portion 14 by suitably inflating and deflating cell 10. Associated with each cell 10 is apparatus programmed to provide a desired internal pressure within cell 10 which correlates to a desired interface pressure between portion 12 of cell 10 and the portion of the person situated above cell 10. Thus, each cell 10 is controlled to its own pressure as will be described further below. While illustrative cell 10, shown in FIG. 1, is a cylindrical cell having a generally circular horizontal cross section, it will be appreciated that cells may be generally square, elliptical, rectangular, triangular, hexagonal, or multisided in horizontal cross-section, as well as combinations of these. In some embodiments, portion 12 and wall 13 are made from a flexible material, such as a substantially air impermeable fabric, and base portion is made from a material, such as any of a number of plastic materials, which is more rigid than the flexible material from which portion 12 and wall 13 are made.

In one embodiment, cells 10 are three inches (7.62 cm) in diameter but may be any selected diameter. In some embodiments, each cell 10 has a diameter ranging from two inches (5.08 cm) to six inches (15.24 cm) or eight inches (20.32 cm) in diameter. The cells 10 in some embodiments may have a height 28 ranging, for example, from five inches (12.70 cm) to ten inches (25.40 cm), but cells 10 of any suitable height are within the scope of this disclosure. Typically, the height may be nine inches (22.86 cm), but heights from six inches (15.24 cm) to 12 inches (30.48 cm) or more may be included in some embodiments. The upper surface portion 12 of each cell 10 provides a support for the portion of a person thereabove. When a sufficient number of cells 10 are assembled together they provide a mattress having an upwardly facing surface to support a person. A plurality of such cells 10, for example, may be assembled together to provide a seat for a person. Cells 10 are sufficiently small, in the illustrated embodiments, that at least four or five of such cells 10 are required in a lateral row of a mattress or chair having a typical width. Of course, person support surfaces having rows with less than four or more than five of cells 10 are within the scope of this disclosure.

Figure 2:
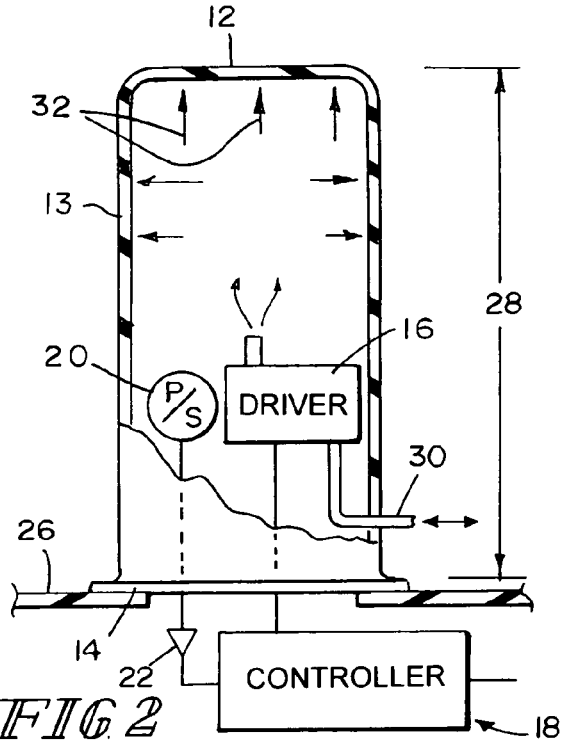
FIG. 2 is a diagrammatic view of an inflation control system associated with the inflatable cell of FIG. 1.
Figure 3:
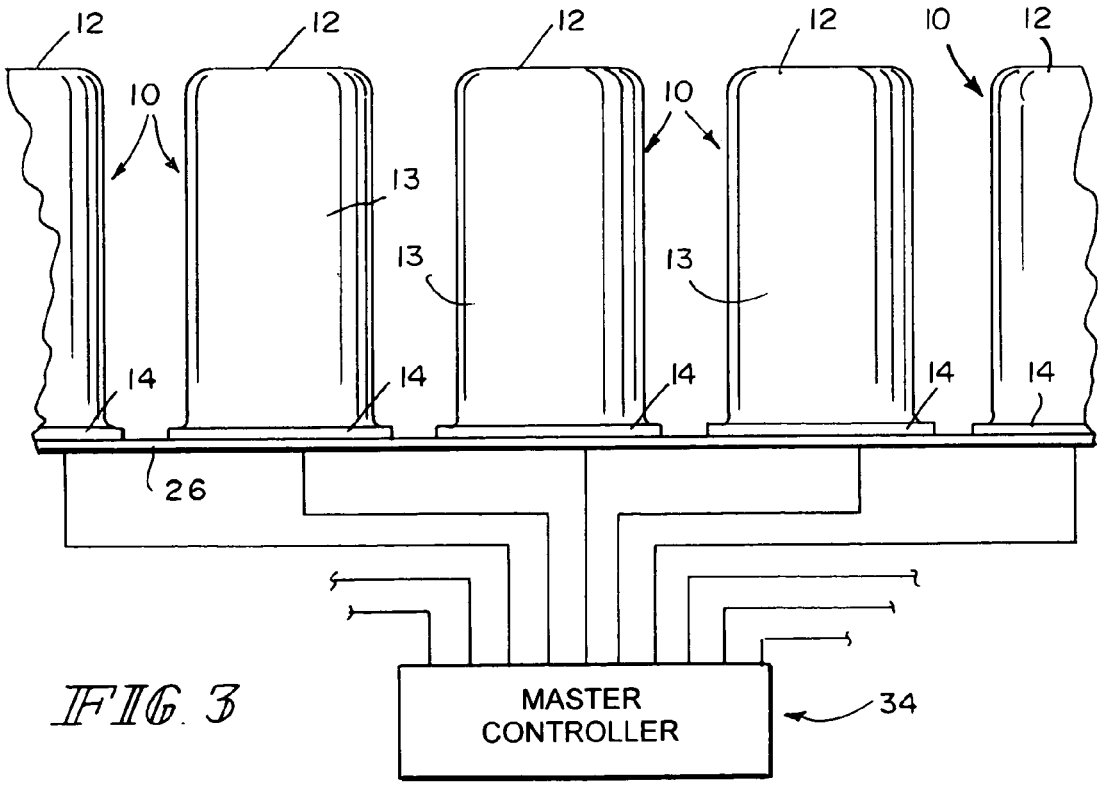
FIG. 3 is a diagrammatic view of multiple inflatable cells coupled to a common controller.

Cells 10 are each supported on a substrate 26 as shown, for example, in FIGS. 1-3. In some instances, the substrate 26 may be part of a patient support deck of a hospital bed or similar apparatus, such as a chair, stretcher, wheelchair, or the like, used in a healthcare facility. In other instances, substrate 26 may be part of a piece of furniture found in a person's home, such as a recliner, a bed, a couch, a chair, or the like. Each cell 10 has associated therewith its own driver 16, such as an air compressor, a pump, a blower, a fan, or the like, which is operable as a source of pressurized air. Illustratively, driver 16 is located within the cell 10 and communicates with the atmosphere through a tube 30 or other suitable conduit. In other embodiments, driver 16 may be situated outside cell 16, such as being coupled to an underside of bottom portion 14, for example, and communicate with the interior region of cell 10 via a suitable conduit.

Each driver 16 is coupled to a controller 18. The operation of driver 16 is commanded by signals received from the controller 18. Driver 16 is operable to inflate cell 10 by pulling air from outside cell 10 through tube 30 or to deflate cell 10 by allowing air inside cell 10 to vent out of cell 10 through tube 30. In other embodiments, separate inflation tubes and deflation tubes are provided between driver 30 and the ambient surroundings around cell 10 in lieu of the single tube 30. Each cell 10 has a pressure sensor 20 therein which senses the pressure inside cell 10 and which provides a pressure signal to the associated controller 18, the signal being amplified by an amplifier 22. Although amplifier 22 is shown as a separate component, amplifier 22 is considered to be part of the circuitry of controller 20.

Controller 22 typically includes other circuit components. For example, the signal from sensor 20 is processed after amplification by an analog-to-digital converter (not shown) to provide a digital signal to a microprocessor or other logic based circuit element(s) which processes the signal in accordance with a control algorithm stored in memory devices of the controller 22. Controller 18 processes the signal from the sensor 20 to determine the pressure within cell 10 (represented by arrows 32) which is dependent, in part, upon a force exerted on upper surface 12. This force correlates to the interface pressure between cell 10 and the person supported thereabove. In the illustrative embodiment, cells 10 are arranged such that gaps are provided between the cells 10 so that cells 10 usually don't contact each other during use. Such gaps may be on the order of ½ inch (1.27 cm) or 1 inch (2.54 cm) or more. If desired, however, the gaps between cells 10 may be less than ½ inch (1.27). In the illustrative embodiment, the gaps are free of any material, but that is not to say that a material could not be placed in the gaps between cells 10, if desired.

When the pressure in cell 10 falls below a specific air pressure set point established in the control algorithm, controller 18 activates the driver 16 to increase the pressure 32 in cell 10 to a second set point established in the control algorithm and then the controller 18 deactivates driver 16. In some embodiments, the controller 18, driver 16, and pressure sensor 20 are all contained within the associated cell 10 with only the tube 30 and one or more wires 24 extending from cell 10. Wires 24 serve as power and data lines to the circuitry of controller 18 and driver 16. In alternative embodiments, a power source such as a battery is provided in cell 10 and external wires 24 are omitted. Substrate 26 has one or more holes beneath each cell 10 through which wires 24 pass and/or within which other components (e.g. driver 16, controller 18, and/or sensor 20) are situated in some embodiments.

In some embodiments, driver 16 comprises one or more valves that are openable to create a vent to atmosphere through the tube 30 to reduce the pressure in cell 10. Such valves of driver 16 are normally closed to block the exit path through tube 30 so that pressurized air is retained within cell 10. In some embodiments, cells 10 have valves that are separate from the associated drivers 16 but operate similarly to open and close the vent path through the respective tubes 30. The determination whether to vent to atmosphere is made by the controller 18 when the pressure 32 exceeds a predetermined air pressure set point and venting is continued until the pressure in cell 10 drops below a predetermined set point. In such embodiments, the controller 18 and the driver 16 work together to maintain a relatively constant pressure in cell 10. Such a relatively constant pressure is typically defined between upper and lower limits defining a pressure tolerance range. By having each of cells 10 with its own driver 16, controller 18, and pressure sensor 20, each cell 10 operates independently of all of the other cells 10 to control its own pressure. In some embodiments, cells 10 are completely self-contained having one or more of the associated driver 16, controller 18, and pressure sensor 20 situated inside the cell 10 or coupled to a portion of cell 10, such as base portion 14, outside the interior of cell 10.

FIG. 3 shows an embodiment in which multiple cells 10 are located together and coupled to the same master controller 34. Each of the cells 10 depicted in FIG. 3 are substantially the same as cells 10 of the illustrative embodiment of FIGS. 1 and 2, with the exception of having a common controller 34, instead of individual controllers 18. In a variation of the FIG. 3 embodiment, cells 10 still have their own individual controllers 18 and the master controller 34 communicates with the controllers 18 of each of the cells 10. The master controller 34 is operable, for example, to change the air pressure set points of the individual controllers 18 as desired to effect a system wide pressure profile goal. Alternatively, master controller 34 commands the operation of the drivers 16 of the various cells 10 without the use of controllers 18.

The master controller 34 receives data indicative of the individual pressures of each cell 10 to determine a mathematical relationship between the cells 10 which is then used to establish a system wide profile of pressures. The goal of the system in some embodiments is to reduce the root mean square (rms) interface pressure between the person and the cells 10 by altering the pressures in each of the cells 10 supporting the person. Controller 34 is able to determine which of cells 10 are supporting a portion of a person thereabove, and which are not, based on data from sensors 20. In some embodiments, controller 34 and/or controllers 18 are operable to substantially equalize pressures in those cells 10 which are determined to be supporting a portion of a person thereabove.

In some embodiments, the goal of the system is to provide massage therapy to the person by alternating the pressures in each of the cells 10 in a preprogrammed manner. In other embodiments, the goal of the system is to configure the cells 10 such that the person is maintained in a particular location on the associated support surface by increasing the height of the cells 10 which do not support any portion of the person relative to those cells 10 that do. In still other embodiments, the goal of the system is to provide either lateral rotation or turning (turn assist) of a person in a prone position on the person support surface 72 by causing cells 10 on one side of the person support surface to have a different height than the cells 10 on the other side of the person support surface. In some embodiments, the goal of the system is selectable among the goals of the embodiments discussed above by receiving an input from a user to select which goal is to be achieved. The master controller 34 may be programmable by a user to establish a cell 10 pressure profile so that the system may automatically operate the drivers 16 as necessary to achieve the desired pressure profile.

Figure 4:
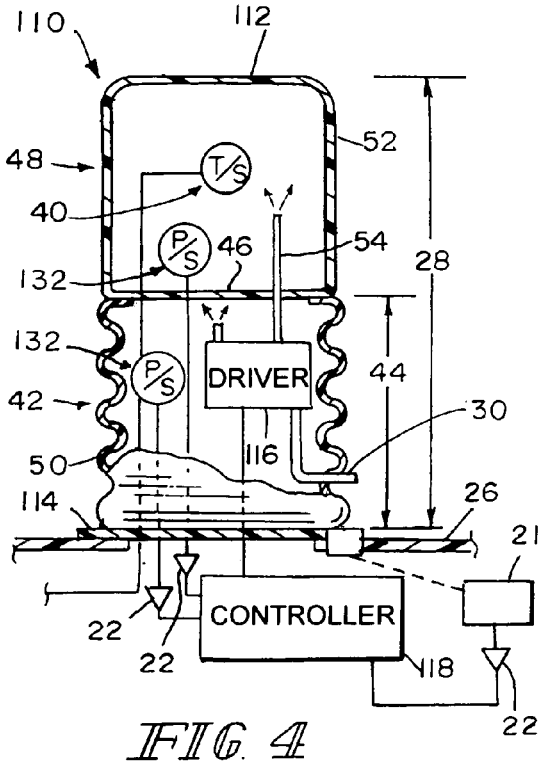
FIG. 4 is a diagrammatic view of another embodiment of an inflatable cell having an upper inflatable chamber with a temperature sensor and pressure sensor therein and having a lower inflatable chamber with a pressure sensor and a driver therein, the sensors and driver being coupled to a controller.

In another embodiment, a cell 110 has an inflatable lower portion 42 and an inflatable upper portion 48 supported above lower portion 42 as shown in FIG. 4. Upper portion 48 comprises an upper wall 112 and a lower wall 46. Wall 112 is joined to wall 46 by an elongated cylindrical wall 52. Portion 48 of cell 110 is substantially air tight in the illustrative embodiment. Portion 42 of cell 110 comprises a base portion 114 and a bellows 50 extending between base portion 114 and wall 46 of portion 48. Located on or within upper portion 48 is a temperature sensor 40. Each of portions 42, 48 has its own pressure sensor 132. Sensors 40, 132 communicate with an associated controller 118. In the illustrative embodiment, sensors 40, 132 of portion 48 are coupled to the controller 118 via electrical lines that pass through wall 46 of the upper portion 48 and through base portion 114 of portion 42 and sensor 132 of portion 42 is coupled to controller 118 via electrical lines that pass through base portion 114.

Cell 110 further comprises a driver 116 that is located in the lower portion 42 and that is operable to individually inflate portions 42, 48. Driver 116 communicates with the upper portion 48 through a tube 54 and communicates pneumatically with the ambient surroundings around cell 110 through a tube 30. Driver 116 also communicates pneumatically with lower portion 42. The driver 16 is a source of pressure, such an air compressor, pump, etc., and has one or more valves that are opened or closed, as appropriate, depending upon whether one or more of portions 42, 48 are to be further inflated or deflated. In the illustrative embodiment, portions 42, 48 are vented to atmosphere through the same tube 30. In other embodiments, separate vent tubes are provided, one for venting portion 42 and the other for venting portion 48. The controller 118 commands the driver 16 to adjust the pressures in portions 42, 48 in accordance with a control algorithm. The pressure in portion 42 may be increased to expand bellows 50 upwardly or decreased to retract bellows 50 downwardly. Expansion of the bellows 50 results in portion 48 being urged or moved upwardly. Retraction of bellows 50 results in portion 48 being relaxed or moved downwardly. Thus, lower portion 42 is pressurized to provide gross movement of upper portion 48 upwardly and downwardly, whereas upper portion 48 is pressurized so as to fine tune an interface pressure on a portion of person supported thereabove.

Determination of whether to expand or retract bellows is made by the controller 118 based on a signal from the sensor 132 located in lower portion 42. This allows a vertical height 44 of lower portion 42 to be adjusted without substantially altering the pressure within upper portion 48. Of course, if upward movement of upper portion 48 is resisted by a load, such as a person thereabove, then the pressure within upper portion 48 may change due to the squeezing effect on upper portion 48 created between the load and expansion of lower portion 42. By managing height 28 of the cell 110 and the pressure within cell 110 independently, the contour of an upper surface of a person support surface having a plurality of cells 110 is controllable generally independently from a pressure profile of the person support surface. For example, the height of cells 110 under the buttocks of a person in a prone position may be controlled to have a lower height than the height of cells 110 under the lower back of the person. In some embodiments, cells 110 of a person support surface are controlled in a manner to maintain generally the same pressure in one or more of portions 42, 48 of each person-supporting cell 110 so that a person's weight is evenly distributed among the cells 110 supporting the person.

In some embodiments, an additional sensor 21, shown in FIG. 4, is located at the interface of the lower base portion 114 of each cell 110 and the associated substrate 26. Sensor 21 provides a detection of the presence of a portion of the person on the particular cell 110 associated with sensor 21 in lieu of monitoring one or both of pressure sensors 132 to make this determination. Sensor 21 provides a signal that is processed through an analog to digital converter (not shown) and an amplifier 22 of controller 118. In some embodiments, sensor 21 is a force sensor and controller 18 uses the signal from sensor 21 to determine the weight of the portion of the person present on the associated cell 110. In some embodiments, controller 18 chooses or calculates pressure set points for one or more of portions 42, 48 based on the weight supported by cell 110. Sensor 21 in the illustrative embodiment of FIG. 4 is enlarged with the dotted line showing the location of the sensor between the lower base portion 114 and the substrate 26. In other embodiments, sensor 21 may be situated between upper portion 48 and lower portion 42. In some embodiments, sensor 21 may be placed on upper surface 112. It will be appreciated by a person having skill in the art that there are many locations throughout the structure of cell 110 and the mounting of cell 110 to substrate 26 where sensor 21 could effectively be located to determine the load placed on the cell 110. The sensor 21 may be, for example, a strain gage type sensor, a capacitive type sensor, an inductive type sensor, or a fiber optic type sensor such as a Taxel™ sensor supplied by Tactex Controls Inc. of Victoria, British Columbia.

Figure 5:
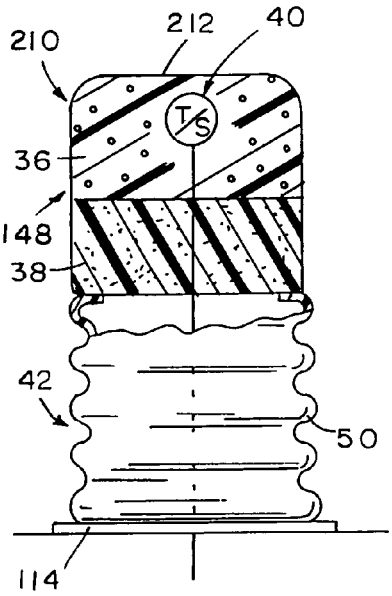
FIG. 5 is a side elevation view, partially in cross section, of another embodiment of an inflatable cell having an upper foam portion with a temperature sensor (shown diagrammatically) and having a lower inflatable portion.

Another embodiment of an inflatable cell 210 is shown in FIG. 5. Cell 210 has an upper portion 148 which comprises an upper foam section 36 and a lower foam section 38. The upper foam section 36 has an upper surface 212. Lower foam section 38 is coupled to the upper foam section 36 and is positioned vertically below the upper foam section 36. In the illustrative embodiment, foam sections 36, 38 are each cylindrical in shape and have substantially the same diameters. Cell 210 has a lower portion 42 which is substantially the same as lower portion 42 of cell 110 and so like reference numbers are used. Thus, portion 42 of cell 210 has a bellows 50 and a base portion 114. However, in cell 210, bellows 50 is coupled to the lower surface of lower foam section 38. The lower portion 42 of cell 210 contains a driver (not shown) that is similar to drivers 16, 116 and that is operable to inflate and deflate bellows 50 to raise and lower, respectively, upper portion 148. A pressure sensor (not shown) similar to pressure sensors 20, 132 and a controller (not shown) similar to controllers 18, 34, 118 are coupled to the driver of cell 210.

Cell 210 further comprises a temperature sensor 40 which, in the illustrative embodiment is embedded in foam section 36 of upper portion 148, and which is coupled electrically to the associated controller (not shown). The controller of cell 210 processes a signal from the temperature sensor 40 which correlates to a temperature of the upper surface 212 of foam portion 36. The signal passes through appropriate circuitry, such as an amplifier (not shown) and an analog to digital converter (not shown) before being processed by the controller (not shown). In some embodiments, the controller signals a temperature control apparatus (not shown), such as a heater or cooler, to deliver hot or cool air to the person via appropriate flow channels, which in some embodiments, may comprise the gaps or spaces between cells 210 of the associated person support surface.

In some embodiments, bellows 50 beneath portions 148 of cells 210 that are sensed to have higher temperatures as compared to other cells 210, are deflated by some amount in an attempt to lower the interface pressure between such cells 210 and the portion of the person supported thereabove, the concept being that cells 210 bearing more of a person's weight have a tendency to become hotter than cells 210 bearing less (or none) of the person's weight. In other embodiments, a temperature control apparatus may be included within lower portion 42 of cell 210 to heat or cool the air within lower portion 42 in an attempt to influence the temperature at surface 212 of foam section 36. Additionally or alternatively, a master controller (not shown) similar to controller 34 receives temperature feedback from multiple cells 210 and signals the temperature control apparatus and/or driver of cells 210 to control localized heating and cooling of particular areas of a person support surface in accordance with a temperature profile algorithm which includes temperature set points for individual cells 210 or zones of cells 210. Person support surfaces in which this localized heating or cooling is performed in conjunction with massage therapy, as discussed above, are within the scope of this disclosure. Thus, a person support surface in accordance with this disclosure may have a closed loop feedback system for controlling the temperature of the upper foam section 36 of one or more cells 210.

Figure 6:
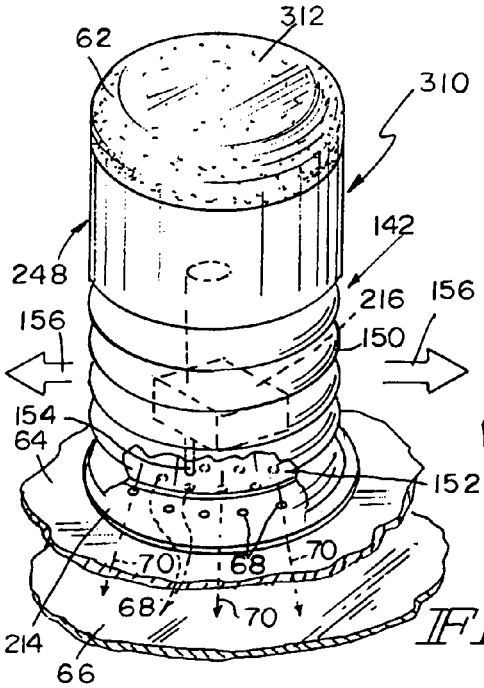
FIG. 6 is a perspective view of an inflatable cell which expels air downwardly to provide an air bearing between a pair of support substrates.

Another embodiment of an inflatable cell 310 comprises a lower portion 142 having an inflatable bellows 150, an intermediate inflatable portion 248, and a topper foam portion 62 situated above portion 248 as shown in FIG. 6. In the illustrative example, lower portion 142 has a base portion 214 that is coupled to a substrate 64 which is supported above a support deck 66 of an underlying piece of furniture such as a hospital bed. A driver 216 (in phantom) is provided to inflate bellows 150 and portion 248 in a manner substantially similar to the manner in which driver 116 of cell 110 inflates portions 42, 48 as described above. A partition wall 152 is provided near the bottom of bellows 150 to subdivide bellows 150 into two pressurizable chambers. Driver 216 is operable to inflate the lower chamber of bellows 150 through a hose 154 or other suitable conduit.

Base portion 214, which provides the bottom surface of cell 310, has several small holes or openings 68 through which pressurized air that is delivered through hose 154 to the lower chamber of bellows 150 by driver 216, is expelled downwardly as indicated by phantom arrows 70. The air expelled downwardly through holes 68 provides an air bearing under person support section 310 and substrate 64 resulting in a lift force being provided between substrate 64 and deck 66. Substrate 64 has one or more holes beneath each cell 310 through which the expelled air passes to impinge upon deck 66. The air bearing facilitates movement of the person support surface, of which multiple cells 310 and substrate 64 are a part, relative to deck 66 as indicated by the arrows 156 in FIG. 6. Such movement of the person support surface comprising cells 310 may be desirable, for example, when moving the person support surface from one piece of furniture to another. It will be appreciated that a person may remain supported above cells 310 during such a transfer.

Foam 62 provides an upper surface 312 of cell 310. In some embodiments, foam 62 is a low ILD foam which also helps reduce pressure on a person's skin. The Indentation Load Deflection (ILD) is a well-known, industry-accepted index indicating the firmness or softness of materials such as urethane foam and other foam rubber materials. The ILD is a number that indicates the load required to compress a test block of foam material by 25%. Thus, foam materials having low ILD numbers are "softer" than foam materials having high ILD numbers. That is, foam materials having low ILD numbers are more easily compressible than foam materials having high ILD numbers. Foam 62 of cell 310 and foam 36, 38 of cell 210 may have any ILD, at the option of the designer, in accordance with this disclosure. In some embodiments of cell 210, foam 36 has a lower ILD than foam 38 but this need not be the case. In some embodiments, foam 36, 38 of cell 210 and foam 62 of cell 310 may be a viscoelastic foam.

Figure 7:
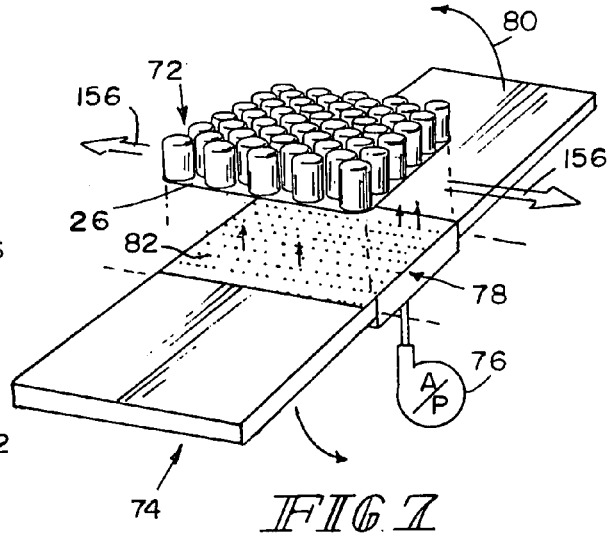
FIG. 7 is a perspective view of a person support deck having a plenum to provide an air bearing to facilitate transfer off of the person support deck of a person support section having a plurality of inflatable cells.

In another embodiment, illustrative support sections 10 are coupled to a substrate 26 to form a seat section 72 of an associated person support surface as shown in FIG. 7. Seat section 72 is configured to mount onto or rest atop a seat portion of a support platform 74 as also shown in FIG. 7. In this embodiment, platform 74 comprises an air source 76 which is coupled to an air plenum 78 of platform 74. Platform 74 is articulable as indicated by arrow 80 in FIG. 7. Air source 76 is operable to pressurize air plenum 78 resulting in air being forced upwardly out of holes 82 provided at the top of plenum 78. The forced air provides an air bearing between platform 74 and seat section 72 resulting in a lift force being applied to substrate 26. The air bearing facilitates transfer of seat section 72 off of, or onto, platform 74 as represented by the arrows 156 in FIG. 7.

If platform 74 is placed adjacent to another platform, a person can be transferred from one platform to another with relative ease. While the plenum 78 of illustrative platform 74 of FIG. 7 is situated beneath seat section 72 of the associated person support surface, it is contemplated that, in some embodiments, the entire support platform 74 may have multiple air plenums such that a head section (not shown) and a leg section (not shown) are transferable simultaneously with the transfer of seat section 72. It is contemplated that seat section 72 and the associated head and leg sections are of the size of an entire mattress and that the entire mattress may be transferred from one person support platform to another regardless of whether plenum 78 is the only plenum 78 of deck 74 or whether deck 74 has additional plenum sections, such as in the head or leg sections of deck 74.

Figure 8:
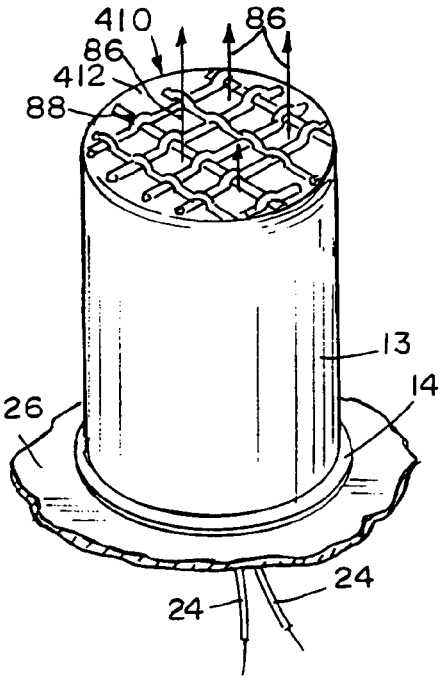
FIG. 8 is a perspective view of an inflatable cell having an air permeable top through which air is expelled upwardly.

In another embodiment, an inflatable cell 410 has an upper surface portion 412 which is made from an air permeable material 88 as shown in FIG. 8. Other portions of cell 410 are similar to cell 10 and therefore, like reference numerals are used to denote those portions. Cell 410 will normally be part of a person support surface having multiple cells 410. Because material 88 is air permeable, pressurized air is expelled upwardly through one or more openings provided in surface portion 412 as indicated by arrows 86 in FIG. 8. In the illustrative example, material 88 comprises a fabric and openings are provided between strands of the fabric. In some embodiment, fabric 88 comprises an undulated mesh material such as SpaceNet™ material. In other embodiments, the material 88 is otherwise an air impermeable material which has discrete holes formed therein to provide the openings through which pressurized air is expelled upwardly. In some embodiments, cell 410 has a temperature sensor and temperature control apparatus similar to that described above in connection with cell 210.

Figure 9:
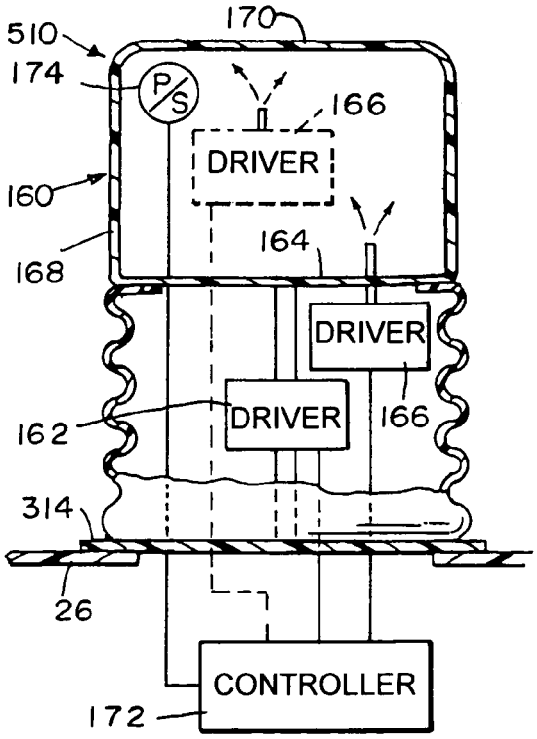
FIG. 9 is a diagrammatic view of an alternative embodiment of an inflatable cell having an inflatable upper portion and a lower portion with a driver to raise and lower the inflatable upper portion.

In yet another embodiment, shown in FIG. 9, an inflatable cell 510 has an inflatable upper portion 160 which is raised and lowered mechanically by an underlying driver 162, such as an electric motor and linkage assembly, a small linear actuator, a small hydraulic cylinder, a small pneumatic cylinder, or the like. In such an embodiment, driver 162 is coupled to a base portion 314 of cell 410 and to a bottom 164 of portion 160. Driver 162 is operable to change the distance between bottom 164 and base portion 314 to raise and lower portion 160. In some embodiments, bottom 164 of portion 160 is made from a material that is sufficiently rigid to withstand the forces imparted thereon by driver 162. In other embodiments, an upper portion of driver 162 which engages bottom 164 of portion 160 has a plate or other substantially rigid structure that extends beneath bottom 164 across a sufficient surface area to support portion 160 thereabove. A side wall 168 and a top wall 170 of portion 160 are made from a flexible material.

In the illustrative example of cell 510, bellows 50 serves as a protective shield to driver 162 and other components of cell 510. Cell 510 has another driver 166, either situated within bellows 50 as shown in FIG. 9 (in solid) or in upper portion 160 as shown in FIG. 9 (in phantom), which is operable to inflate and deflate portion 160. Regardless of the location of driver 166 in cell 510, an appropriate vent path (not shown) is provided to direct air from portion 166 to the ambient surroundings around cell 510. If driver 166 is situated within bellows 50, then bellows 50 may be provided with one or more holes therethrough and driver 166 may simply vent pressurized air from portion 160 into the space defined by bellows 50, which pressurized air will eventually leak through the one or more holes provided in bellows 50 to the ambient surroundings. If driver 166 is in upper portion 160 and bellows 50 has one or more vent holes, a vent conduit (not shown) may vent from driver 166 into the space defined by bellows 50. In other embodiments, a hose similar to hose 30 of cells 10, 110 is provided to direct pressurized air from driver 166 to the ambient surrounding of cell 510.

The operation of drivers 162, 166 is commanded by a controller 172 which receives pressure data from a pressure sensor 174 situated in upper portion 160. Controller 172, therefore, signals driver 162 to raise portion 160 relative to base portion 314 or to lower portion 160 relative to base portion 314 in accordance with a control algorithm. Controller 172 further signals driver 166 to maintain a desired set point pressure in portion 160 within a tolerance range as also dictated by the control algorithm. In some embodiments, cell 510 has a sensor (not shown) to measure a distance at which portion 160 is elevated above base portion 314 or to measure some other distance that correlates to a relative elevation of portion 160. Controller 172 may be coupled to a master controller (not shown) which is, in turn, coupled to the controllers 172 of other cells 510. The master controller in such an embodiment may control the overall contour of an associated person support surface via appropriate operation of drivers 162 and may control the overall pressure profile of the associated person support surface via appropriate operation of drivers 166.

While several embodiments of inflatable cells 10, 110, 210, 310, 410, 510 have been discussed above, it should be readily apparent to one skilled in the art that many combinations of the structures disclosed are possible. Moreover, the discussion above regarding how to control an aspect (e.g., temperature, pressure, movement) of one or more of cells 10, 110, 210, 310, 410, 510 is applicable to all other cells 10, 110, 210, 310, 410, 510. Furthermore, in the discussion of FIG. 7 above and FIGS. 10-21 below, a person support surface has cells 10. However, it is within the scope of this disclosure for any of these person support surfaces to have any of cells 10, 110, 210, 310, 410, 510. In addition, person support surfaces having multiple types of cells 10, 110, 210, 310, 410, 510 (for example, a first zone of cells 10, a second zone of cells 110, a third zone of cells 210, and so on, as well has having various types of cells 10, 110, 210, 310, 410, 510 dispersed in an orderly pattern or even randomly) are within the scope of this disclosure. Furthermore, while various examples of drivers have been mentioned above, other drivers may include but are not limited to, for example, one or more electrically activated springs, one or more electromechanical drives, one or more air bellows, one or more air bladders, one or more pneumatic cylinders, one or more hydraulic cylinders, or one or more combinations of a piston, a crank arm, and a means to rotate the crank arm.

Figure 10:
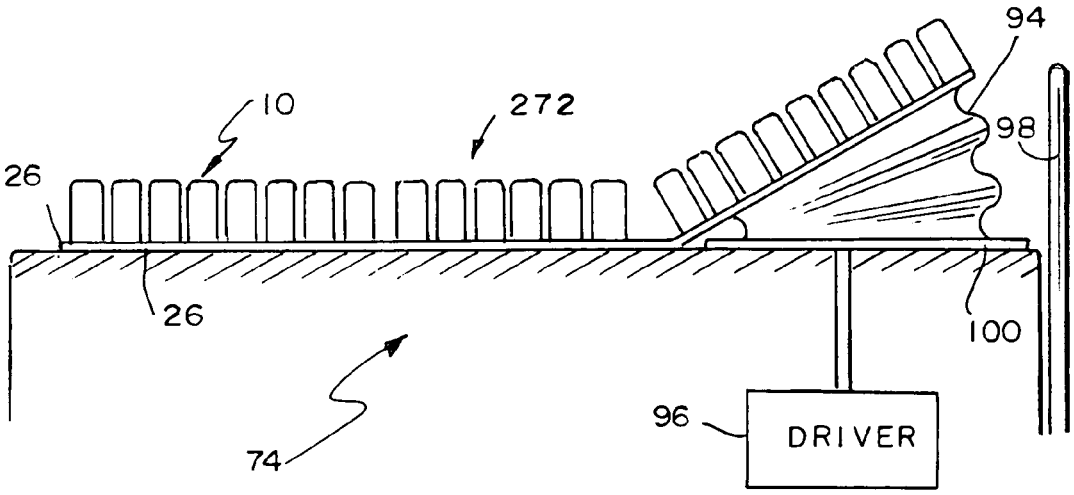
FIG. 10 is a diagrammatic view of a bed with a person support surface having an articulable head section.

As discussed above in connection with FIG. 7, a plurality of cells 10 are coupled to a substrate 26 to create a seat section 72 of a person support surface. FIG. 10 shows an illustrative embodiment of a support platform 74 with a person support surface 272 located thereon. This configuration of surface 272 may be typical of a configuration to be used in the home environment on a standard bed frame. The support platform of FIG. 10 illustratively comprises a bellows 94, a driver 96 and a headboard 98. The driver 96 comprises one or more of an air compressor, a valve, a controller, a power source, a sensor, and a user interface. The bellows 94 is coupled to the bottom of a portion of substrate 26 associated with a head section of surface 272. The bellows 94 is also coupled to a substrate 100 which rests on the top surface of support platform 74. When air is forced into the bellows by driver 96, the pressurized air urges bellows 94 to expand, thereby pivoting or articulating the head section upwardly which results in elevation of the person's shoulders and head.

In the illustrative embodiment of FIG. 10, substrate 26 is a single piece of material having sufficient flexibility to achieve the maximum articulated position when bellows 94 is inflated to its maximum extent. In other embodiments, a hinge or other type of pivot joint may be provided between generally rigid sections of substrate 26. Operation of this articulation function is achieved by a user making inputs to the user input portion of the driver 96. The input signal is processed by the controller which then commands the valves and air compressor to perform the function input by the user. While the illustrative embodiment of FIG. 10 shows only the head section being articulated, it should be clear that a similar approach can be used to articulated other sections (e.g. seat, thigh, and foot sections) of the person support surface 72.

Figure 11:
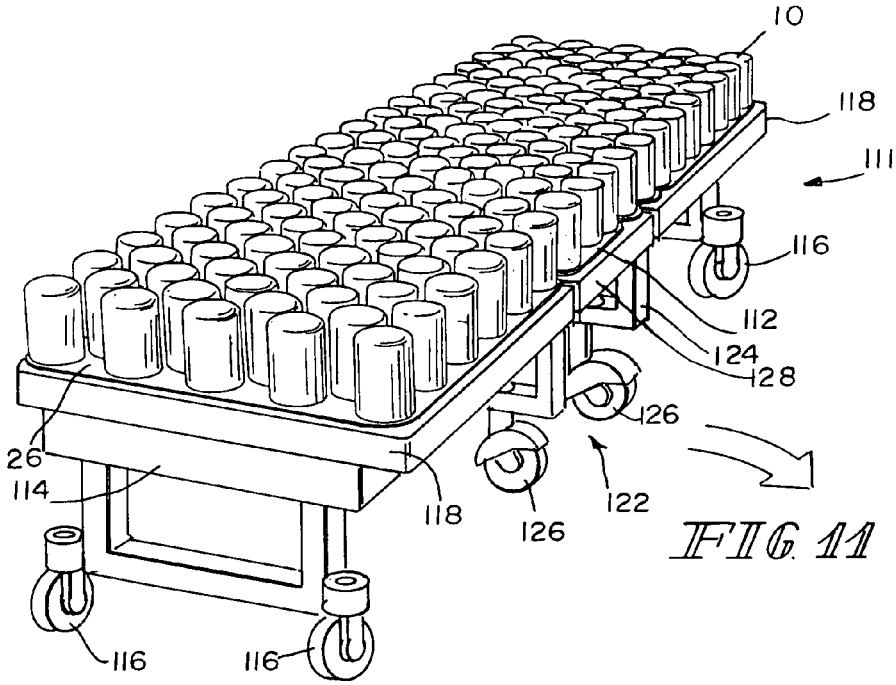
FIG. 11 is a perspective view of a person support apparatus having a removable section.
Figure 12:
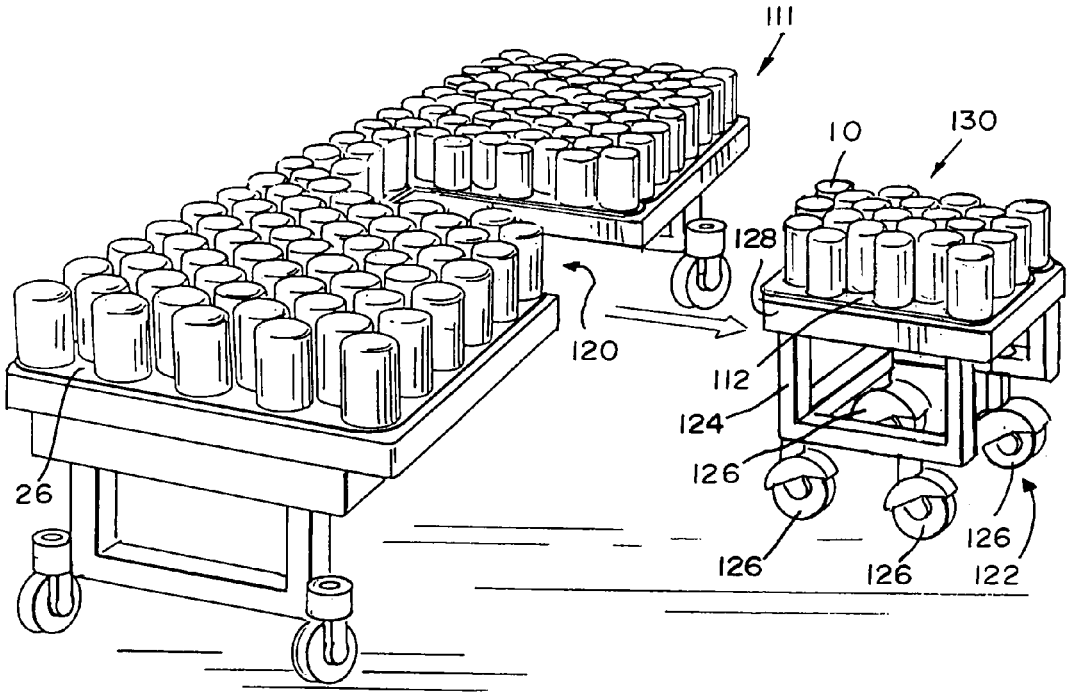
FIG. 12 is a perspective view of the person support apparatus of FIG. 11 with the removable section removed.

Referring now to FIGS. 11 and 12, cells 10 are coupled to substrate 26 and to a second substrate 112. The plurality of cells 10 coupled to substrate 26 in FIGS. 11 and 12 are placed on a person support platform 111. Platform 111 comprises a frame 114, a plurality of casters 116, and a cutout support deck 118. FIG. 12 most clearly shows a cutout area 120. The cutout area 120 is configured to receive a cart 122. The cart 122 comprises a frame 124, a plurality of casters 126, and a person support deck 128. When cart 122 is placed into cutout 120, as shown in FIG. 11, the combination of cart 122 and support frame 111 form a continuous person support structure similar to a bed. The cart 122 serves a second purpose as a mobility device for a person. The person support surface formed by cells 10 and substrate 112, which will be designated as person support surface 130, is configured to provide the support for a person in a sitting position.

When placed in cutout 120, cart 122 is coupled to support platform 111 by a suitable mechanism, such as one or more latches, locks, dockers, or the like, to prevent unwanted movement of cart 122. Once a person is sitting upright on cart 122, cart 122 can be released from support platform 111 to allow the person and cart 122, along with surface 130 supported on cart 122, to be moved away from support platform 111. While FIGS. 11 and 12 show a simplified cart, it will be appreciated by those skilled in the art that the cart may further comprise articulable armrests and an articulable seatback which is raised when the cart 122 is used for person mobility.

Figure 13:
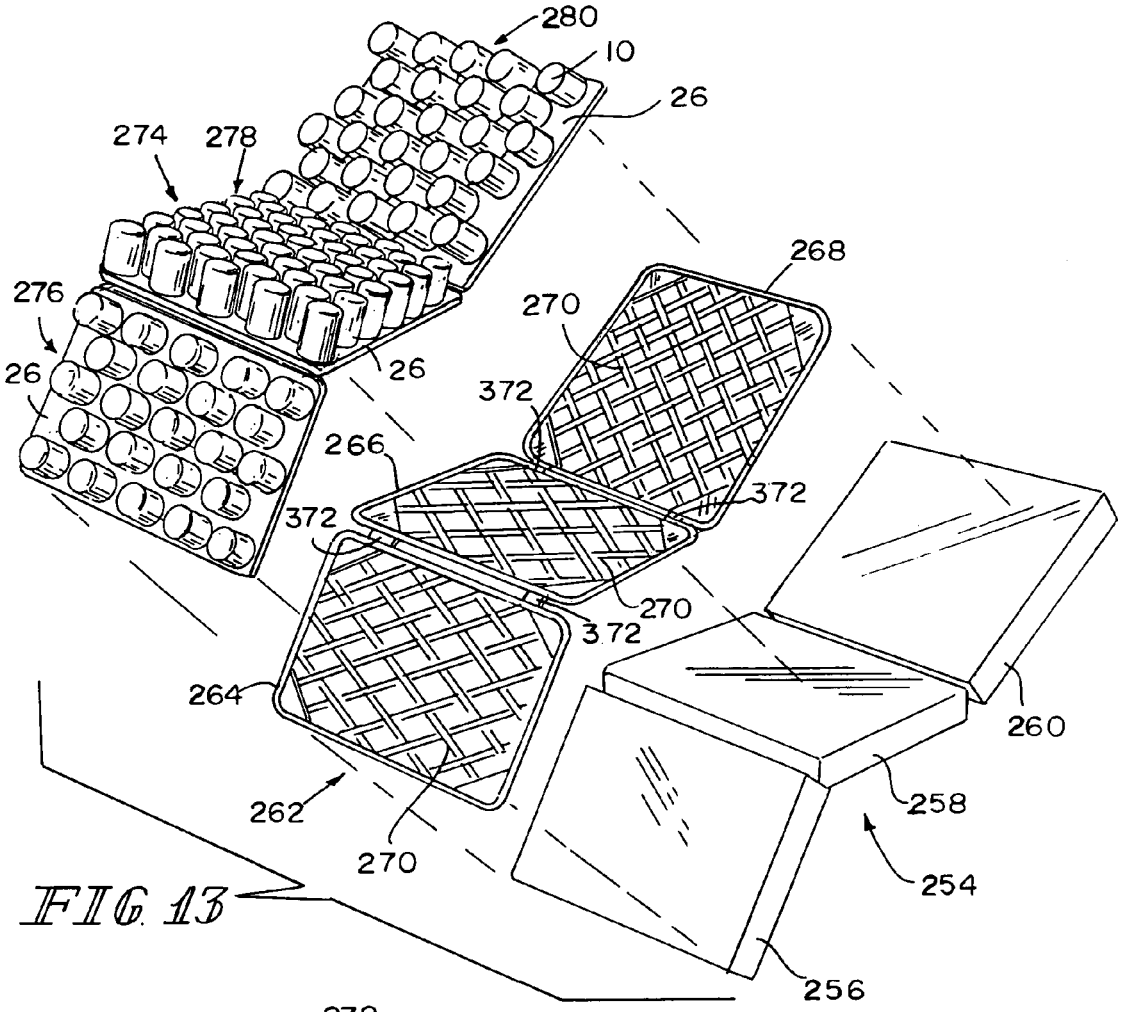
FIG. 13 is an exploded view of a person support with a person support frame, a person support deck, and a person support surface.

Another embodiment of a person support system is shown in FIG. 13. In the FIG. 13 embodiment, a support platform 254 comprises a foot section 256, a seat section 258, and the head section 260. A support deck 262 comprises a foot section frame 264, a seat section frame 266, and head section frame 268. Foot section frame 264 is pivotally coupled to seat section frame 266 by a pair of hinges 372. Head section frame 268 is pivotally coupled to seat section 266 by an additional pair of hinges 372. Frames 264, 266, 268 each comprise a generally rigid outer peripheral frame member and a plurality of flexible straps 270 which run in a woven pattern diagonally relative to the sides and ends of the associated peripheral frame members. A person support surface 274 has complementary sections 276, 278, 280 to the frames 264, 266, 268 of support deck 262 and sections 256, 258, 260 of platform 254. Foot section 276 is placed on frame 264. Likewise seat section 278 is placed on seat frame 266 and head section 280 is placed on frame 270. FIG. 13 shows this construction in an exploded view.

Figure 14:
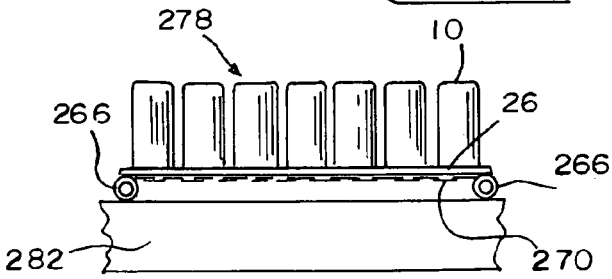
FIG. 14 is a side view of a person support surface resting on a fabric based person support deck supported by a person support frame.

Each of sections 276, 278, and 280 comprises a substrate 26 with a plurality of cells 10 located thereon. In this embodiment, substrate 26 is somewhat flexible and the flexible straps 270 provide an additional load relief characteristic beyond that of cells 10 and substrate 26. As the load is increased on one or more of sections 276, 278, and 280, the associated substrate 26 and flexible straps 270 flex from a straight configuration, shown in FIG. 14, to a bowed or flexed configuration shown in FIG. 15. FIG. 14 shows seat section 278 of surface 274 located on the frame 266 having flexible straps 170 as a support in the area inboard of the associated peripheral frame member of frame 266. Frame 266, in turn, rests on a member 282 of section 258 of platform 254. In FIG. 14, cells 10 of section 278 are not loaded and therefore, there is no deflection of the associated substrate 26 or flexible straps 270. In some embodiments, straps 270 are resiliently extensible so as to lengthen under high enough load conditions and to return to the straight or taut configuration when the load is removed.

Figure 15:
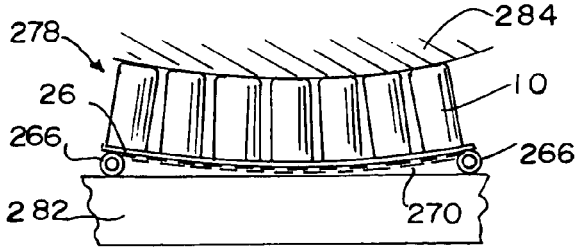
FIG. 15 is a view of the person support surface of FIG. 15 under a person load.

FIG. 15 shows section 278 under a load due to supporting a portion of a person 284. FIG. 15 shows the deflection of substrate 26 and flexible straps 270 which provides additional load relief prior to the bottoming out of section 278 and straps 270 on member 282. In some embodiments, straps 270 are made of a flexible but resilient woven fabric material which allows air flow through the material. The flexure of the combination of straps 270 and substrate 26 helps to compensate for excessive loads on the support surface 274.

Figure 16:
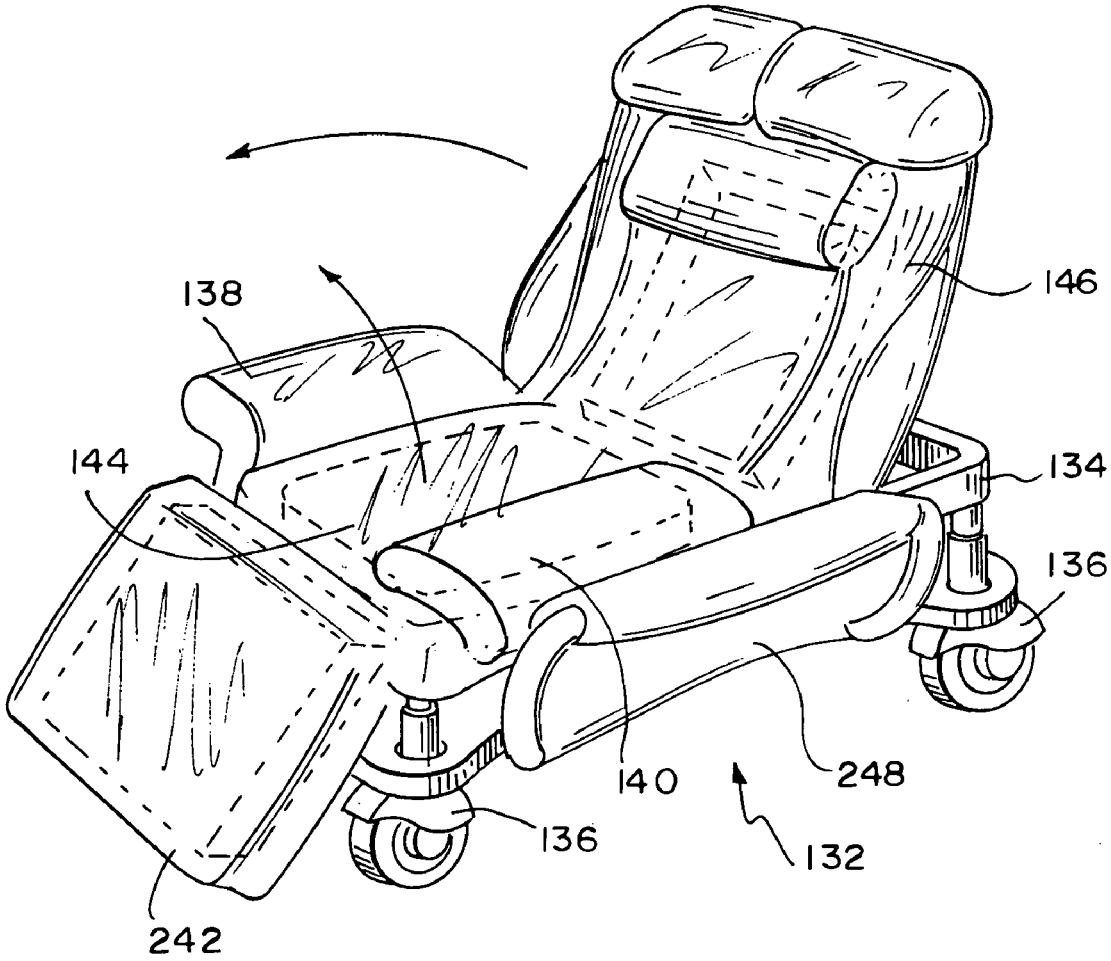
FIG. 16 is a perspective view of a chair bed.

Referring now to FIG. 16, a chair bed 132 comprises a frame 134, a plurality of casters 136, a plurality of side members 248, a foot section 242, a seat section 144, a head section 146, a right-handed arm rest 138 and a left-hand arm rest 140. Sections 144, 146, 242 form an articulable person support surface. The construction of this type of apparatus is known and has been disclosed in prior patents such as U.S. Pat. No. 6,163,903 to Weismiller et al. or U.S. Pat. No. 5,479,666 to Foster et al., which are hereby incorporated by reference herein.

Sections 144, 146, 242 each comprise a plurality of cells 10 which are covered by a topper and by a cover or upholstery. In some embodiments, the toppers comprise one or more pieces of foam that span over the cells 10 of a particular section 144, 146, 242. Additionally or alternatively the toppers of sections 144, 146, 242 comprise an undulated mesh fabric material, such as the Spacenet™ material mentioned above. Toppers having other types of material, such as air bladders, gel layers, beads, and the like are also within the scope of this disclosure. The cover of sections 144, 146, 242 extends over the top of these sections and also surrounds the sides and ends of these sections. In some embodiments, the cover also extends beneath the bottom of each of sections 144, 146, 242. Covers which only partially cover any of the top, bottom, sides, or ends of sections 144, 146, 242 are within the scope of this disclosure. The cover comprises fabric upholstery in some embodiments.

Figure 18:
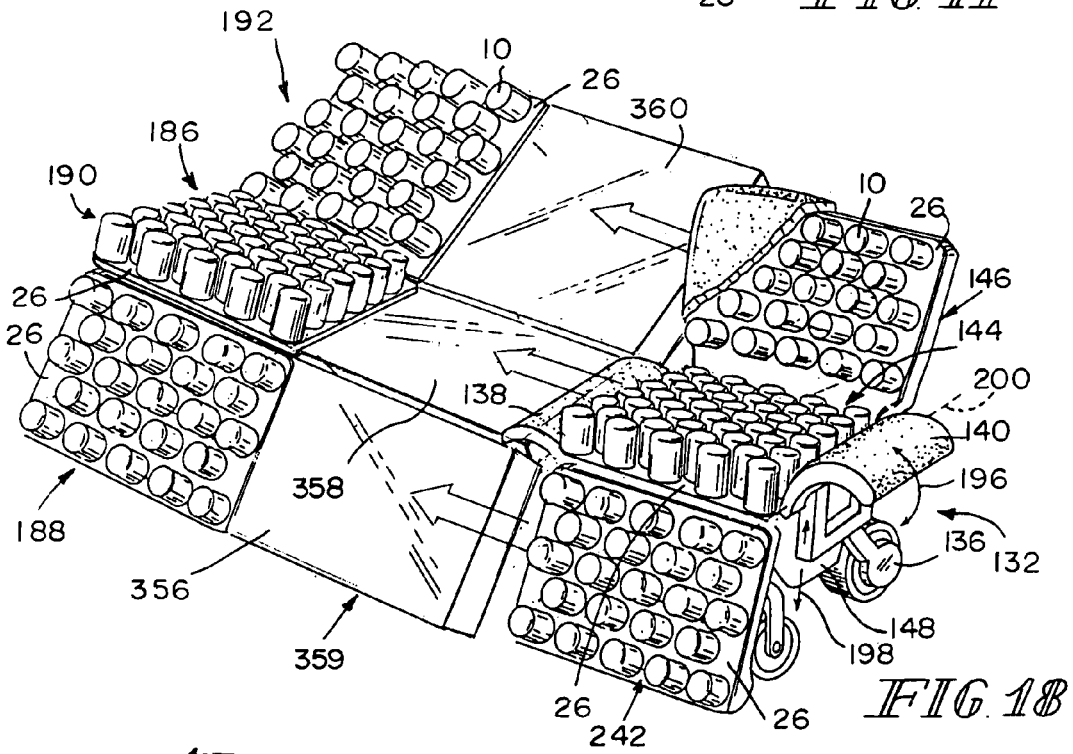
FIG. 18 is a perspective view of a chair bed adjacent to a person support in preparation for a transfer of the person support surface with the chair arm forming a transfer bridge.
Figure 19:
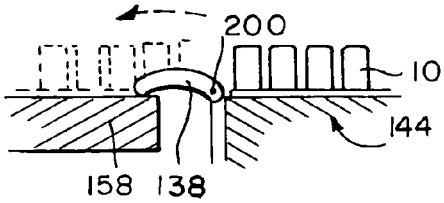
FIG. 19 is an end elevation view of a chair bed arm engaged with a person support to bridge the transfer of the person support surface.

The arm rests 138 and 140 are independently articulable between a raised use position, shown in FIG. 13, and a lowered position below the surface of seat section 144. Additionally, arm rests 138, 140 are articulable to an intermediate position, between the raised and lowered positions, in which arm rests 138, 140 engage a second person support platform as is best shown in FIGS. 18 and 19 with regard to arm rest 138. In some embodiments, the wheels of some or all of casters 136 are powered to assist in moving the chair bed 132. For example, one or more motors may be provided in, or coupled by a suitable transmission to, the wheels of the rear casters 136 to power the wheels to propel chair bed 132 along an underlying floor.

Figure 17:
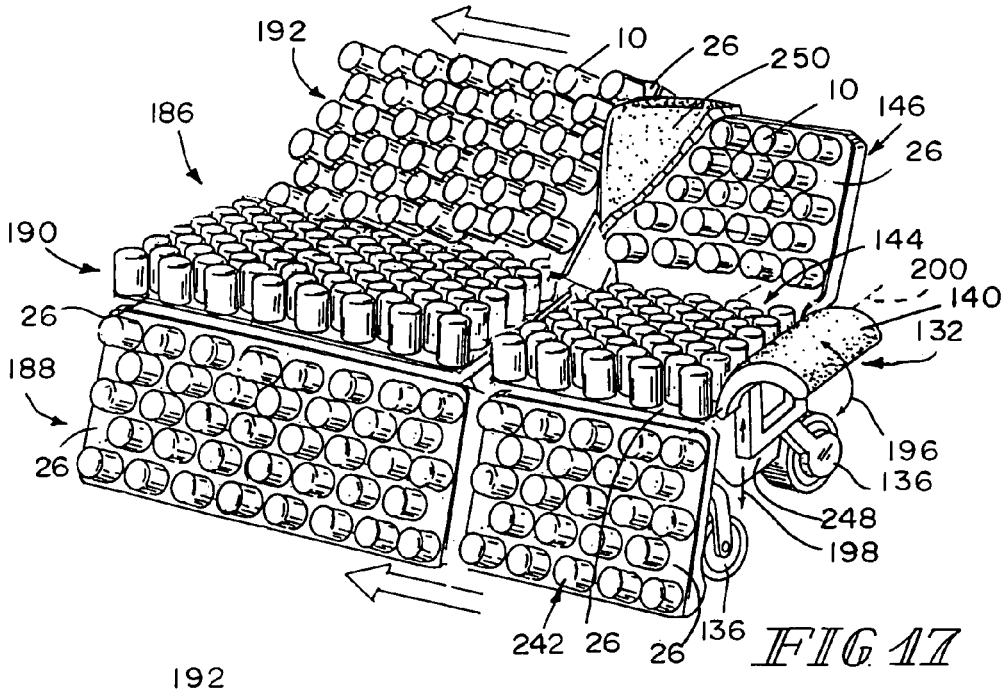
FIG. 17 is a perspective view of a chair bed adjacent another person support in preparation for a person only transfer.

The chair bed 132 of FIG. 16 may be placed adjacent to another person support 186 as shown in FIG. 17. In FIG. 17, the chair bed 132 is shown with much of its outer cover and topper 150 removed such that the underlying cells 10 and substrates 26 can be seen. In the illustrative example, person support 186 is an articulable bed which comprises a foot section 188, a seat section 190, and a head section 192. Support 186 is also shown with cover and topper removed such that its cells 10 and substrates 26 can be seen. Support 186 is articulable such that it can be configured to achieve a complementary articulation to that of chair bed 132. This capability allows chair bed 132 to be placed adjacent to person support 186 as shown in FIG. 17 in preparation for a surface-to-surface transfer of a person from the chair bed 132 to the support 186.

Figure 20:
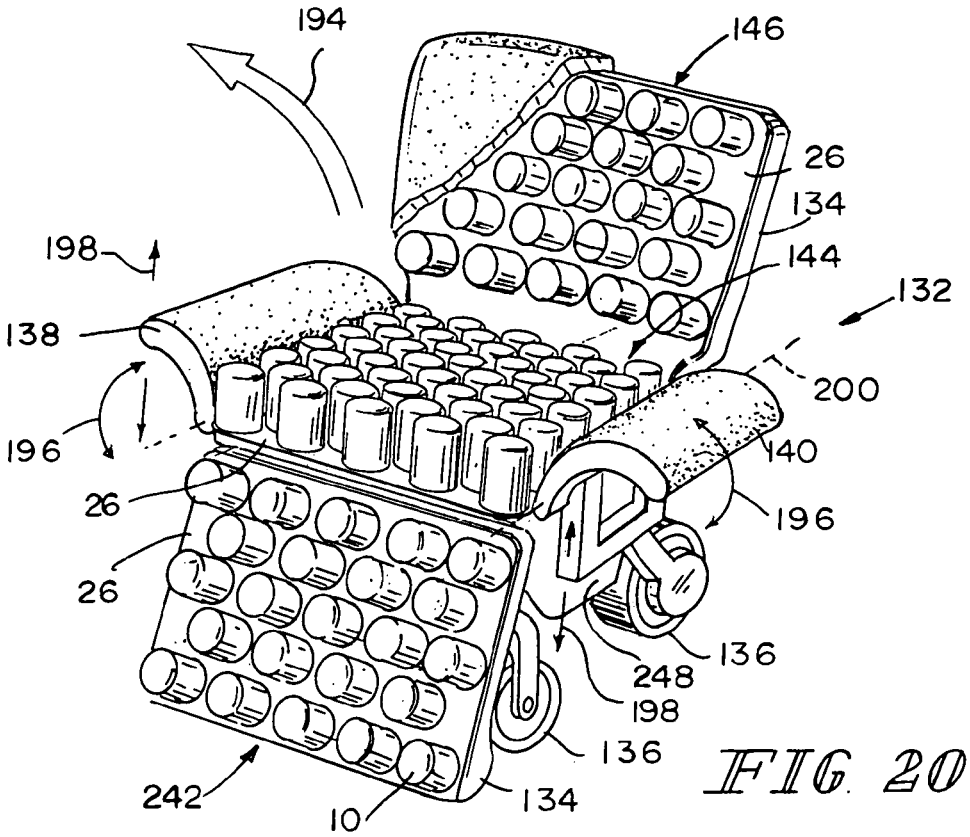
FIG. 20 is a perspective view of a chair bed having person support sections which each include a plurality of inflatable cells.

Arm rests 138 and 140 are movable vertically upwardly and downwardly relative to sections 144, 146, 242 of chair bed 132 as indicated by arrows 198 in FIGS. 17, 18, and 20. Thus, the height of arm rests 138 and 140 is adjustable relative to seat section 144 at the discretion of a person on the chair bed 132. During articulation, arm rests 138 and 140 rotate about a pivot axis 200. Articulation of one or the other of arm rests 138, 140 of chair bed 132 to the intermediate position, allows the articulated one of arm rests 138, 140 to engage a surface of a support deck 359 as shown in FIG. 19 where a right arm rest 138 has been articulated to engage a seat deck section 358 of deck 359. Deck 359 also has a head deck section 360 and a leg deck section 356. After the arm rest 138 engages seat deck section 358, the entire person support surface formed by sections 144, 146, 242 can be transferred from the chair bed 132 to the support deck 186.

In the embodiment shown in FIG. 18, person support 186 has sections 188, 190, 192 covering only half of the support deck 359. The exposed portion of deck sections 356, 358, 360 is sized to receive and accommodate sections 144, 146, 242 of chair bed 132. The right armrest 138 of chair bed 132 serves as a bridge between seat section 144 of chair bed 132 and seat deck section 358 of deck 359. In the FIG. 17 embodiment, a person is transferred off of the person support surface of chair 132 and onto the person support surface of support 186, whereas in the FIG. 18 embodiment, the entire person support surface of chair-bed 132 along with the person thereon is transferred onto deck 359 of support 186. Thus, after the pressure profile and/or mode of operation of sections 144, 146, 242 is selected or determined for a particular person, sections 144, 146, 242 may be transferred between a bed, such as support 186, and a chair, such as chair bed 132. Because sections 144, 146, 242 are transferred with the person, there is no need to have two separate person support surface pressure profiles and modes of operation configured for the person on two separate person support surfaces.

Figure 21:
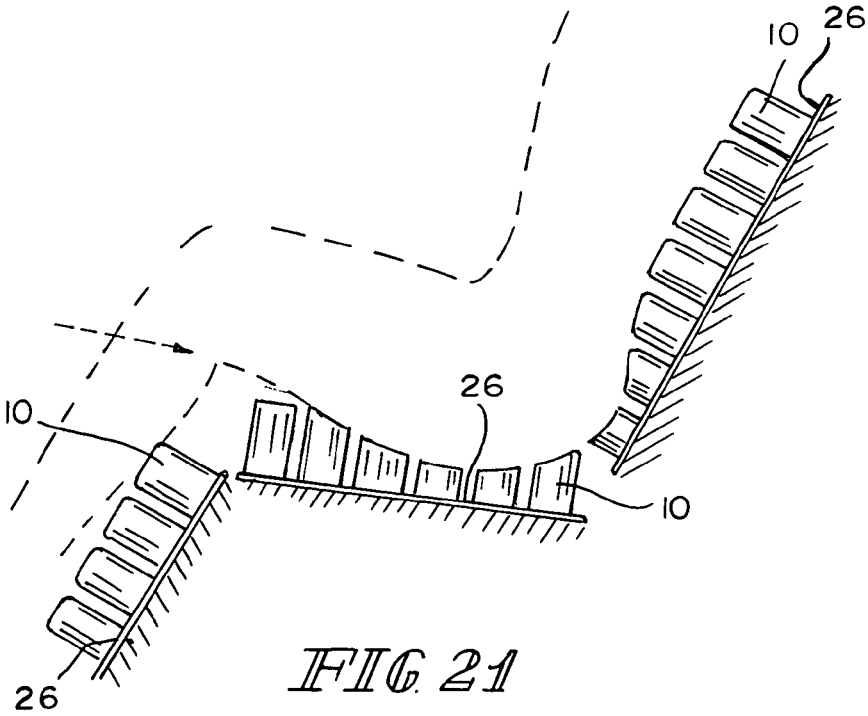
FIG. 21 is a side view of a person support surface under load in an articulated position.

Once a person is placed on a person support surface as shown in FIG. 21, cells 10 adjust to the individual loads and conditions experienced by each of the cells 10. As shown in FIG. 21, depending on the location of the cells 10, the articulated positions of the support sections, and the person's characteristics (e.g., size and weight), the loading conditions will typically vary from cell to cell. For example, the loads on cells 10 associated with the buttocks area when the person is in a seated position are much higher than the loads experienced in the same area when the support sections are articulated to a substantially flat, horizontal orientation to support the person in a prone position. According to this disclosure, the pressures within cells 10 are adjusted automatically by the associated driver 16 and controller 18 (and/or controller 34) depending upon the loading conditions of the individual cell 10.

In some embodiments, the density of the cells 10 (e.g. the size of the cells 10 and/or the spacing between the cells 10) may vary from zone to zone within a support section, or may vary in density from section to section. A relatively low density of cells 10 is shown in the embodiment of FIG. 20 in which cells 10 are relatively large and spaced apart by a relative large distance. In some embodiments, the cells 10 may be smaller in height and/or in diameter and cells 10 may be more closely packed together such that, in some instances, some cells 10 may actually contact or touch each other. Additionally, in some embodiments in which cells 10 have polygonal horizontal cross-sections, the sides of adjacent cells 10 may be placed in surface-to-surface contact over a generally planar area.

In some embodiments, a separate pump in situated outside of sections 10, 110, 210, 310, 410, 510 and connects to a valve situated within each individual section 10, 110, 210, 310, 410, 510 such that opening and closing of such valves controls the inflation of the associated inflatable cell 10, 110, 210, 310, 410, 510. In such embodiments therefore, a central source of air under pressure may be coupled to multiple cells and the pressure in each cell is controlled by controlling the position of the valve in each cell. Such valves in each cell may have vent positions to vent pressurized air from the cell to the ambient surrounding either directly or via an appropriate vent conduit.

Figure 22:
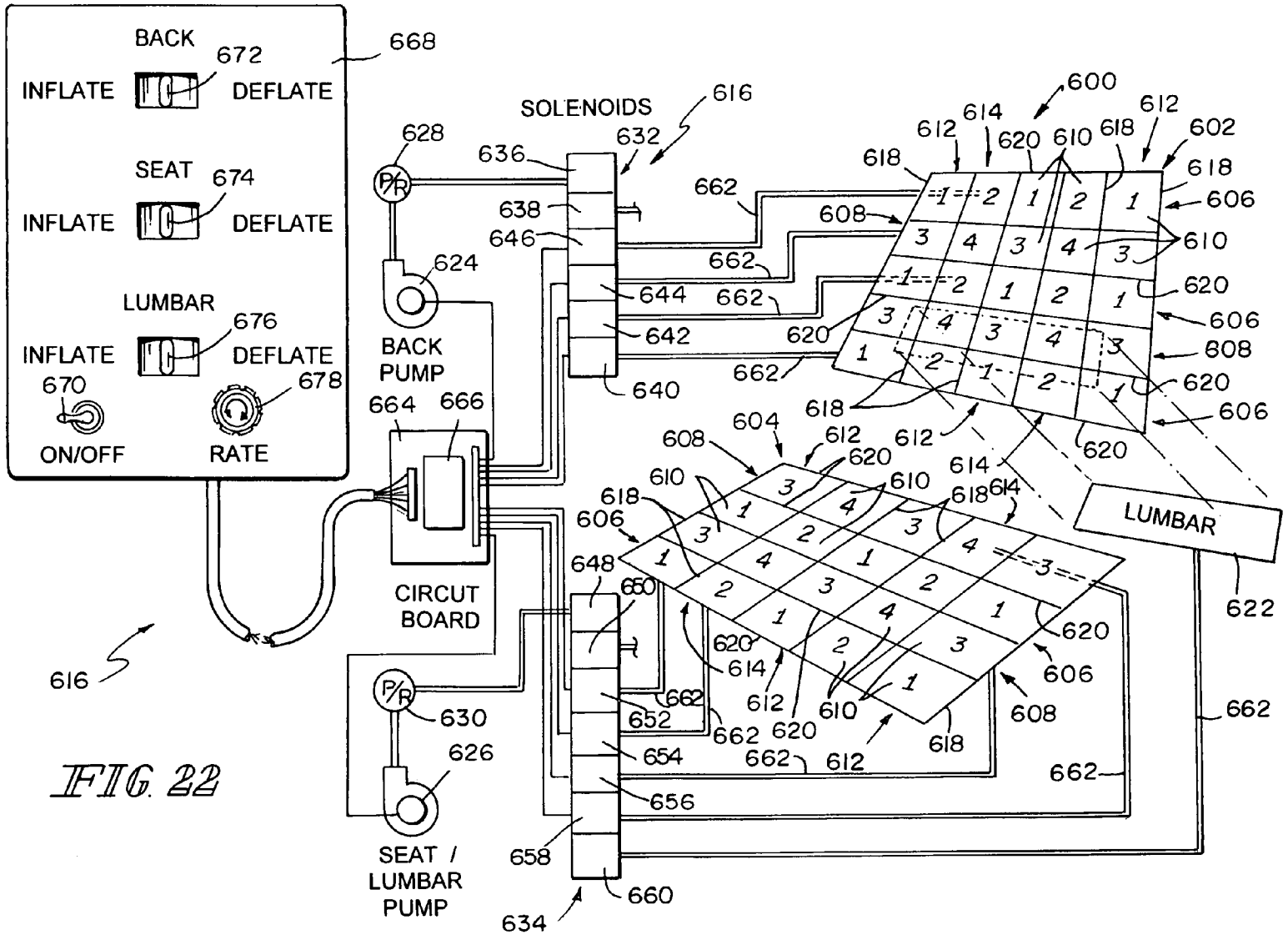
FIG. 22 is a diagrammatic view of a person support surface having seat and back sections with a plurality of inflatable cells arranged in rows and columns and having first, second, third, and fourth subsets of the inflatable cells each being controlled as a group by an inflation control system of the person support surface.

While the dynamic digital person support surface embodiments disclosed herein may comprise individual cells 10, 110, 210, 310, 410, 510, each with its own controller, driver, sensors, etc. as described, it will be appreciated that a plurality of such cells may be grouped together to act together under a common controller or common driver. For example, each transverse row of cells may be grouped and controlled together. When cells are grouped together, they may share common sensors, common drivers, or common controllers. Any and all patterns of cell grouping are within the scope of this disclosure. One such possible grouping of cells is shown in FIG. 22 and will be discussed in further detail below. Person support surfaces having any of cells 10, 110, 210, 310, 410, 510 which are controlled individually may also have other inflatable sections comprising one or more inflatable cells that are inflated and deflated as a group. For example, one of a back section, a seat section, or a leg section of a chair or bed may have individually controlled cells, such as any of cells 10, 110, 210, 310, 410, 510, and the other two of the back section, seat section and leg section of the chair or bed may have a plurality of cells that are controlled as a group.

Referring now to FIG. 22, a person support surface 600 has a back section 602 and a seat section 604. Each section 602, 604 comprises a plurality of inflatable cells 610 which are arranged in an array of rows and columns. A first group of the rows of sections 602, 604, which is designated by reference number 606, comprises a first subset of the inflatable cells 610, indicated by number "1" on the appropriate cells 610, and a second subset of the inflatable cells 610, indicated by number "2" on the appropriate cells 610. A second group of the rows of sections 602, 604, which is designated by reference number 608, comprises a third subset of the inflatable cells 610, indicated by number "3" on the appropriate cells 610, and a fourth subset of the inflatable cells 610, indicated by number "4" on the appropriate cells 610. Rows 606 having the first and second subsets of cells 610 alternate with the rows 608 having the third and fourth subsets of cells 610. Sections 602, 604 have alternating columns 612 and columns 614 in which columns 612 include the first and third subsets of cells 610 and columns 614 include the second and fourth subsets of cells 610.

Person support surface 600 also has an inflation control system 616 which is operable to selectively inflate and deflate the plurality of inflatable cells 610. System 616 has an alternating pressure mode in which each of the inflatable cells 610 of the first, second, third, and fourth subsets of inflatable cells 610 are sequentially deflated and then re-inflated substantially as a group. Thus, during the alternating pressure mode various ones of the first, second, third, and fourth subsets of inflatable cells 610 are deflated while the other three of the first, second, third, and fourth subsets of inflatable cells 610 are inflated. Such deflation of a particular group of cells 610 may be either a complete deflation (e.g., equalization with atmospheric pressure) or a partial deflation (e.g., pressure lower than the pressures of the inflated cells 610 but above atmospheric pressure). Furthermore, when it is stated that the other three of the first, second, third, and fourth subsets of inflatable cells 610 "are inflated," it is intended to cover situations where the inflated cells 610 are further inflated (e.g., additional pressurized air is introduced into the cells 610 to increase the pressure therein) as well as situations where the inflated cells 610 remain inflated (e.g., additional pressurized air is not introduced into the cells 610).

In the illustrative embodiment, when all cells 610 are inflated and then alternating pressure mode is initiated, the cells 610 labeled "1" are deflated for a period of time while cells 610 labeled "2-4" remain inflated. After a predetermined period of time, cells 610 labeled "1" begin to inflate while cells 610 labeled "2" begin to deflate with cells labeled "3" and "4" remaining inflated. Eventually cells 610 labeled "1" reach the desired inflation set point and stop inflating and cells 610 labeled "2" achieve the desired amount of deflation. After a predetermined period of time, cells 610 labeled "2" begin to inflate while cells 610 labeled "3" begin to deflate with cells labeled "1" and "4" remaining inflated. Eventually cells 610 labeled "2" reach the desired inflation set point and stop inflating and cells 610 labeled "3" achieve the desired amount of deflation. After a predetermined period of time, cells 610 labeled "3" begin to inflate while cells 610 labeled "4" begin to deflate with cells labeled "1" and "2" remaining inflated. Eventually cells 610 labeled "3" reach the desired inflation set point and stop inflating and cells 610 labeled "4" achieve the desired amount of deflation. After a predetermined period of time, cells 610 labeled "4" begin to inflate while cells 610 labeled "1" begin to deflate with cells labeled "2" and "3" remaining inflated. Eventually cells 610 labeled "4" reach the desired inflation set point and stop inflating and cells 610 labeled "1" achieve the desired amount of deflation. The cycle repeats the sequence in a similar manner until alternating pressure mode is exited. A similar alternating pressure mode control scheme may be used for sections having any of cells 10, 110, 210, 310, 410, 510, in lieu of cells 610.

In the illustrative example, each of sections 602, 604 comprise a pair of flexible sheets of material that are coupled together along longitudinal seams 618 and lateral seams 620 such that cells 610 are formed by the material above and below the spaces or pockets bounded by seams 618, 620. In the illustrative embodiment, seams 618, 620 are straight. In other embodiments, one or more of seams 618, 620 may have other geometries such as curved, sinusoidal, jagged, or the like, as well as having other orientations, such as being diagonal. Seams 618, 620 are welded seams (e.g., heat welded, radio frequency welded, or ultrasonic welded) in some embodiments. However, seams 618, 620 may be formed by stitching and/or via use of adhesive in other embodiments. In the illustrative example, those seams 618, 620 which are not at the outer periphery of sections 602, 604 separate adjacent cells 610. In other embodiments, two or more seams may be provided between cells 610 and the spaces between such seams which are not associated with cells 610 may be used for other purposes, such as conduit routing, electrical wire routing, thermoregulation fluid routing, and the like.

Surface 600 may further have a cover and/or topper overlying the plurality of inflatable cells 610. Such a cover and topper for surface 600 may comprise any of the materials mentioned above in connection with the discussion of covers and toppers for other disclosed embodiments. Illustrative surface 600 also has an inflatable lumbar bladder 622 which is supported partially by the lowermost row 606 of section 602 and partially by the row 608 adjacent the lower most row 606 of section 602 as indicated by the dotted outline in FIG. 22. If surface 600 has a topper, bladder 622 may be situated between the topper and the underlying cells 610 or bladder 622 may be situated on top of the topper. If surface 600 has a cover, bladder 622 is typically situated inside the cover although that need not be the case. Lumbar bladder 622 is inflated to provide additional lumbar support to a person supported on surface 600.

Inflation control system 616 has a first pump 624 and a second pump 626 as shown diagrammatically in FIG. 22. System 616 may have other types of drivers, such as compressors, blowers, reservoirs of pressurized air, or the like, in lieu of pumps 624, 626 in other embodiments. Pump 624 communicates through a first pressure regulator 628 with a first bank 632 of solenoid valves. Similarly, pump 626 communicates through a second pressure regulator 630 with a second bank 634 of solenoid valves. The first bank 632 of solenoid valves (referred to hereinafter simply as "solenoid (s)") includes a pump isolation solenoid 636, a vent solenoid 638, a first cell group solenoid 640, a second cell group solenoid 642, a third cell group solenoid 644, and a fourth cell group solenoid 646. The second bank 634 of solenoids includes a pump isolation solenoid 648, a vent solenoid 650, a first cell group solenoid 652, a second cell group solenoid 654, a third cell group solenoid 656, a fourth cell group solenoid 658, and a lumbar solenoid 660.

Each of solenoids 640, 642, 644 646, 652, 654, 656, 658, 660 has a conduit 662 leading therefrom to the associated portion of support surface 600. It will be appreciated that each conduit 662 may comprise multiple segments and may branch out via appropriate segments to connect to the associated cells 610 or bladder 660. Banks 632, 634 of solenoids may be mounted to one or more manifolds (not shown) which provide appropriate flow passages from each of pumps 624, 626 and from each of vent solenoids 638, 650 to the other solenoids 640, 642, 644, 646, 652, 654, 656, 658, 660 to permit inflation and deflation of cells 610 and bladder 622. Alternatively or additionally, solenoids 636, 638, 640, 642, 644, 646 may be coupled together and have appropriate flow passages therethrough and solenoids 648, 650, 652, 654, 656, 658, 660 may be coupled together and have appropriate flow passages therethrough to permit inflation and deflation of cells 610 and bladder 622.

System 626 has one or more circuit boards 664 having appropriate circuitry, such as illustrative microprocessor 666, for controlling operation of pumps 624, 626 and solenoids 636-660 to inflate and deflate cells 610 and bladder 622. Circuit board 664 has other components, such as one or more memory chips for storing a control algorithm, solenoid drivers for applying appropriate voltage levels to open and close solenoids 636-660, power supply circuitry including a transformer, for example, and the like. System 626 also has one or more pressure sensors (not shown) included on circuit board 664 or coupled to solenoids 636-660 or situated elsewhere in system 616 (e.g., inside cells 610 and bladder 622 or coupled to conduits 662) to sense pressure of cells 610 and bladder 622.

In the illustrative embodiment, even though lumbar bladder 622 is supported on back section 602, the second pump 626 which is used to inflate the cells 610 of the seat section 604, is also used to inflate the lumbar bladder 622. In other embodiments, pump 624 is used to inflate the lumbar bladder 622 and in such embodiments, solenoid 660 is included in bank 632 of solenoids rather than in bank 634 of solenoids. The circuitry of circuit board 664 signals solenoids 636-660 to open and close in the appropriate manner and to operate pumps 624, 626 in the appropriate manner, according to a control algorithm, to inflate and deflate cells 610 and bladder 622.

To give one example, if cells 610 labeled "1" of section 602 are to be deflated, solenoids 636, 642, 644, 646 are signaled to close and solenoids 640, 638 are signaled to open so that pressurized air from cells 610 labeled "1" vents to atmosphere through the associated conduit 662, solenoids 640, 636, and the flow passages between solenoids 640, 636. To give another example, if cells 610 labeled "2" are to be inflated, then solenoids 636, 642 are signaled to open; solenoids 638, 640, 644, 646 are signaled to close; and pump 624 is signaled to operate to force pressurized air through solenoids 636, 640 and associated flow passages, including the conduits 662 associated with the cells 610 labeled "2," and into the cells 610 labeled "2." Based on the two preceding examples, those skilled in the art will understand how system 616 operates to inflate and deflate the other cells 610 and bladder 600. The one or more pressure sensors of system 616 provided feedback to controller regarding the pressure of the particular cells 610 or bladder 622 being inflated or deflated.

System 616 further comprises a user input device 668 which is coupled to circuit board 664 as shown in FIG. 22. Although a wired connection is shown, device 668 and circuit board 664 may be configured for wireless communication within the scope of this disclosure. Device 668 is a hand-held pendant in some embodiments and is mounted to the furniture (not shown) which supports sections 602, 604 of surface 600 in other embodiments. Device 668 includes an on/off switch 670 which is used to turn surface 600 on and off, a back switch 672 which is operable by a user to increase and decrease set point pressures of the cells 610 of section 602, a seat switch 674 which is operable by a user to increase and decrease set point pressures of the cells 610 of section 604, a lumbar switch 676 which is operable by a user to increase and decrease set point pressures of the lumbar bladder 622, and a rate knob 678 which is operable by user to control a time period between which the first, second, third, and fourth subsets of inflatable cells 610 are deflated during the alternating pressure mode.

In the illustrative example, switches 672, 674, 676 are three position switches which are normally biased to a middle, neutral position. A user resting on sections 602, 604 of surface 600 is able to move any of switches 672, 674, 676 in a first direction (e.g., toward the left in FIG. 22) to increase the pressure set point of the associated section 602, 606 or bladder 622. Similarly, the user is able to move any of switches 672, 674, 676 in a second direction (e.g., toward the right in FIG. 22) to decrease the pressure set point of the associated section 602, 604 or bladder 622. In response to the user letting go of whichever one of switches 672, 674, 676 the user has moved, the switch returns to its neutral position and the new pressure set point is stored in memory of the control circuitry of board 664. In the illustrative example, the user chooses the firmness or softness of sections 602, 604 and bladder 622 based on "feel." In other embodiments, one or more displays may be provided on device 668 (or elsewhere) and may be operable to display the pressure set point or other numerical and/or graphical representation of the firmness level of the associated section 602, 604 and bladder 622. User inputs may be provided on device 668 for entry of the weight of the person in some embodiments.

Although device 668 has toggle type switches 670, 672, 674, 676 and rotatable knob 678, other types of user inputs may be provided in lieu of these. For example, buttons, touch screens, membrane switches, levers, keys, and the like are suitable user inputs.

Although certain embodiments have been described in detail above, variations and modifications exist within the scope and spirit of this disclosure as described and as defined in the following claims.

The invention claimed is:

1. A person support surface comprising a plurality of inflatable cells, each cell having a height and a width with the height of each cell being greater than the cell width, each inflatable cell having at least one side wall and a top wall such that an interior region of said inflatable cell is defined by the associated at least one side wall and by the associated top wall, a plurality of pressure sensors, each pressure sensor being associated with a corresponding one of the plurality of inflatable cells and sensing a pressure at which the corresponding inflatable cell is inflated, and a plurality of drivers, each driver being associated with only a single corresponding one of the plurality of inflatable cells, each driver being operable to pump pressurized air into the interior region of the corresponding cell to individually inflate the corresponding inflatable cell without inflating any of the other inflatable cells of the plurality of inflatable cells, the plurality of inflatable cells including at least three inflatable cells, the plurality of pressure sensors including at least three pressure sensors, and the plurality of drivers comprising at least three drivers, each driver comprising at least one of a pump, a compressor, a blower, or a fan that is situated within the interior region of the corresponding inflatable cell such that the top wall of the inflatable cell overlies the at least one pump, compressor, blower, or fan and such that the at least one side wall surrounds the at least one pump, compressor, blower, or fan.

2. The person support surface of claim 1, wherein each pressure sensor is situated within the interior region of the corresponding inflatable cell.

3. The person support surface of claim 2, where the at least one side wall of each of the plurality of inflatable cells comprises a cylindrical side wall that surrounds the associated driver.

4. The person support surface of claim 1, wherein the at least one side wall of each of the plurality of inflatable cells comprises a cylindrical side wall that surrounds the associated driver.

5. The person support surface of claim 1, wherein the plurality of drivers are configured so that pressurized air in the plurality of cells is ventable out of the plurality of cells through the associated driver.

6. The person support surface of claim 1, wherein the plurality of inflatable cells comprise a plurality of upstanding cylindrical cells.

7. The person support surface of claim 1, further comprising a controller coupled to each of the plurality of pressure sensors to receive pressure data therefrom, the controller being coupled to each of the plurality of drivers, and the controller being operable to signal the plurality of drivers to further inflate the corresponding inflatable cell.

8. The person support surface of claim 1, further comprising a plurality of temperature sensors to sense the temperature of a portion of each of the plurality of inflatable cells, each temperature sensor being associated with a corresponding one of the plurality of inflatable cells.

9. The person support surface of claim 1, further comprising a plurality of foam pads, each foam pad being situated adjacent a top of a corresponding one of the plurality of inflatable cells.

10. The person support surface of claim 9, further comprising a plurality of temperature sensors, each temperature sensor being embedded within a corresponding one of the plurality of foam pads.

11. The person support surface of claim 9, further comprising a controller coupled to the plurality of pressure sensors and to the plurality of drivers and the controller being operable to command the operation of the drivers to inflate and deflate the inflatable cells to raise and lower, respectively, the foam pads so as to alter an interface pressure between the foam pads and a person supported thereabove.

12. The person support surface of claim 1, wherein the interior region of each inflatable cell of the plurality of inflatable cells comprises an upper inflatable chamber and a lower inflatable chamber and each of the plurality of drivers is operable to separately inflate the upper and lower inflatable chambers of the corresponding inflatable cell.

13. The person support surface of claim 12, wherein each of the drivers is situated within the lower inflatable chamber of the corresponding inflatable cell.

14. The person support surface of claim 12, wherein the lower inflatable chamber of each of the inflatable cells is configured as a bellows that is expandable and retractable to raise and lower, respectively, the corresponding upper inflatable chamber.

15. The person support surface of claim 12, further comprising a controller coupled to the plurality of pressure sensors and to the plurality of drivers and the controller being operable to command the operation of the drivers to inflate and deflate the lower inflatable chambers to raise and lower, respectively, the upper inflatable chambers so as to alter an interface pressure between the upper inflatable chambers and a person supported thereabove.

16. The person support surface of claim 1, wherein the top wall of at least some of the inflatable cells have least one opening through which pressurized air is expelled upwardly.

17. The person support surface of claim 1, wherein at least some of the inflatable cells comprises a bottom surface having at least one opening through which pressurized air is expelled downwardly.

18. The person support surface of claim 1, further comprising a topper covering the plurality of inflatable cells.

19. The person support surface of claim 18, wherein the topper comprises foam.

20. The person support surface of claim 18, wherein the topper comprises an undulated mesh material.

21. The person support surface of claim 1, wherein the plurality of inflatable cells are arranged in an array of rows and columns.

22. The person support surface of claim 21, further comprising at least one controller commanding the plurality of drivers to inflate and deflate each of the plurality of inflatable cells in a preprogrammed manner.

23. The person support surface of claim 21, wherein the top wall of each of the plurality of inflatable cells has an upper surface and further comprising at least one controller commanding the plurality of drivers to inflate and deflate each of the plurality of inflatable cells to raise and lower, respectively, the upper surfaces of the inflatable cells in a preprogrammed manner.

24. The person support surface of claim 1, further comprising a controller coupled to the plurality of pressure sensors and to the plurality of drivers, the controller being operable to determine which of the plurality of inflatable cells is supporting a person based on data received from the pressure sensors, and the controller being operable to command the operation of the drivers so as to substantially equalize the pressures in those inflatable cells of the plurality of inflatable cells which have been determined to be supporting the person.

25. The person support surface of claim 1, further comprising a second plurality of inflatable cells, the second plurality of inflatable cells being inflated and deflated as a group.

26. A person support surface as recited in claim 1 and further comprising the maximum width of each cell being from two to eight inches and a height of each cell being from five to twelve inches.

* * * * *